US010577861B2

(12) United States Patent
LeBlanc

(10) Patent No.: US 10,577,861 B2
(45) Date of Patent: Mar. 3, 2020

(54) ROLL-UP SHADES WITH STRAPS, CONNECTORS, AND FASTENERS, AND METHODS OF USING SAME

(71) Applicant: Lewis Hyman, Inc., Carson, CA (US)

(72) Inventor: Robert LeBlanc, Kennesaw, GA (US)

(73) Assignee: Lewis Hyman, Inc., Carson, CA (US)

( * ) Notice: Subject to any disclaimer, the term of this patent is extended or adjusted under 35 U.S.C. 154(b) by 0 days.

(21) Appl. No.: 16/153,210

(22) Filed: Oct. 5, 2018

(65) Prior Publication Data

US 2019/0383097 A1 Dec. 19, 2019

Related U.S. Application Data

(60) Provisional application No. 62/686,842, filed on Jun. 19, 2018.

(51) Int. Cl.

| | |
|---|---|
| ***E06B 9/34*** | (2006.01) |
| ***E06B 9/80*** | (2006.01) |
| ***E06B 9/326*** | (2006.01) |
| ***E06B 9/42*** | (2006.01) |
| ***E06B 9/325*** | (2006.01) |

(52) U.S. Cl.

CPC ..... *E06B 9/80* (2013.01); *E06B 9/325* (2013.01); *E06B 9/326* (2013.01); *E06B 9/34* (2013.01); *E06B 9/42* (2013.01)

(58) Field of Classification Search

CPC ..... E06B 9/324; E06B 9/325; E06B 9/326; E06B 9/42; E06B 9/80; Y10T 24/51; Y10T 24/3485; Y10T 24/45304; Y10T 24/45288

USPC ..... 24/370–374

See application file for complete search history.

(56) References Cited

U.S. PATENT DOCUMENTS 185,470 A * 12/1876 Ardnt ..... E06B 9/42 160/256
458,848 A * 9/1891 Hudgens ..... A44B 11/008 267/73
1,009,533 A * 11/1911 Lacey ..... A01K 13/008 139/88
2,188,134 A 1/1940 Hough
2,370,406 A * 2/1945 King ..... D03C 9/0683 139/88
2,842,822 A * 7/1958 Bennett ..... F16B 45/06 24/370

(Continued)

OTHER PUBLICATIONS

International Search Report dated Oct. 7, 2019 of International application No. PCT/US2019/037622.

(Continued)

*Primary Examiner* — Katherine W Mitchell
*Assistant Examiner* — Jeremy C Ramsey
(74) *Attorney, Agent, or Firm* — Jones Day

(57) ABSTRACT

A shade configured to be rolled up or down by a user includes a plurality of slats, a plurality of weaving cords which attach the plurality of slats together, at least one strap including a top end and a bottom end, the top end being attached to one of the plurality of slats at a back side of the shade and the bottom end being a free end including a connector. A method of using the shade includes rolling up the shade to a first rolled up position and securing the rolled up portion of the shade by wrapping the strap around the rolled up portion and securing the strap to a front side of the shade. A fastener may also be used to secure a rolled up portion of the shade.

4 Claims, 20 Drawing Sheets

(56) References Cited

U.S. PATENT DOCUMENTS

| | | | | |
|---|---|---|---|---|
| 8,113,493 | B2 * | 2/2012 | Shen | F16F 3/04 267/70 |
| 2004/0060670 | A1 | 4/2004 | Judkins | |
| 2008/0000595 | A1 | 1/2008 | Cohen | |
| 2008/0099165 | A1 | 5/2008 | Birch | |
| 2011/0146922 | A1 | 6/2011 | Colson et al. | |
| 2011/0247767 | A1 | 10/2011 | Chen | |
| 2017/0218701 | A1 | 8/2017 | Lin | |

OTHER PUBLICATIONS

Written Opinion dated Oct. 7, 2019 of International application No. PCT/US2019/037622.

* cited by examiner

ROLL-UP SHADES WITH STRAPS, CONNECTORS, AND FASTENERS, AND METHODS OF USING SAME

CROSS-REFERENCE TO RELATED APPLICATION

This application claims the benefit of priority under 35 USC § 119(e) of U.S. Provisional Patent Application No. 62/686,842, filed Jun. 19, 2018, which is incorporated herein by reference in its entirety for all purposes.

BACKGROUND

1. Field

The following description relates to roll up shades, straps, and connectors for holding up the shades. In addition, a method including wrapping straps or connectors around shades for holding up the shades is also described.

2. Description of Related Art

Shades are items that people frequently use indoors and outdoors to hang in windows, patios, porticos, and sunrooms to block sun, reduce heat and other weather elements. Shades roll up and down to allow light to enter an area or room. Shade materials include polyvinyl chloride (PVC), bamboo, grass, reed, among other materials. They are widely used in homes, apartments, businesses, hotels, and conference rooms.

Typically, shades are rolled up and down using a cord system with hanging cords which allow a user to adjust the position of the shade on the window. For example, by pulling a cord, the user is able to pull up the shades. Similarly, by releasing the cord, the user is able to allow the shades to move down and cover the window. Hanging cords present a serious risk of injuries and even death to children. About one child a month dies from being entangled in cords from blinds and shades, and more than 16,000 children in the United States were treated in emergency departments for injuries caused by window blinds between 1990 and 2015, an average of almost two children every day. New standards by American National Standards Institute (ANSI) and Window Covering Manufacturers Association (WCMA) are prohibiting cords from the operational method of rolling up and down shades in order to protect children and pets.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In an aspect, a shade configured to be rolled up or down by a user includes a plurality of slats, a plurality of weaving cords which attach the plurality of slats together, at least one strap including a top end and a bottom end, the top end being attached to one of the plurality of slats at a back side of the shade and the bottom end being a free end including a connector.

The connector may include at least one of a hook, an adhesive, hook and loop, a clip, or a button.

In response to the user rolling up the shade, the connector may become visible to the user from a front side of the shade and hang from the back side beneath a rolled-up portion so that the user may attach the connector to the front side to keep the rolled-up portion in position.

The top end of the at least one strap may be attached at a position which is between ¼ a total length of the shade away from a top end of the shade and ⅜ a total length of the shade away from the top end of the shade.

The top end of the at least one strap may be attached at a position which is about ¼ a total length of the shade away from a top end of the shade or about ⅜ a total length of the shade away from the top end of the shade.

The at least one strap may include at least two straps one of which is attached at a position which is about ¼ a total length of the shade away from a top end of the shade and another which is attached at a position which is about ⅜ a total length of the shade away from the top end of the shade.

The shade may further include a stow away storage strap for securing the shade in a rolled-up storage position.

The shade may further include at least one support cord which attaches the plurality of slats together and which is thicker than each of the plurality of weaving cords.

The top end of the at least one strap may include a non-removable clip which is permanently attached to the at least one support cord at the back side of the shade.

The top end of the at least one strap may include a removable clip which is removably attached to the at least one support cord at the back side of the shade.

The top end of the at least one strap may include a removable hook which is removably attached to the at least one support cord at the back side of the shade.

The at least one support cord may be at least twice as thick as each of the plurality of weaving cords.

The shade may be equal to or less than 60 inches in length and the at least one support cord may include at least two support cords.

The shade may be greater than 60 inches in length and the at least one support cord may include at least three support cords.

The at least one support cord may be configured to support a downward force applied by the rolled-up portion of the shade which is attached to the at least one support cord using the at least one strap.

In another aspect, a shade configured to be rolled up or down by a user includes a plurality of slats, a plurality of weaving cords which attach the plurality of slats together, and at least one support cord which attaches the plurality of slats together and which is thicker than each of the plurality of weaving cords.

The at least one support cord may be at least twice as thick as each of the plurality of weaving cords.

The shade may be equal to or less than 60 inches in length and the at least one support cord may include at least two support cords.

The shade may be greater than 60 inches in length and the at least one support cord may include at least three support cords.

The at least one support cord may be configured to support a downward force applied by a rolled-up portion of the shade which is capable of being tied to the at least one support cord.

In yet another aspect, a method of using a shade includes providing a shade including a plurality of slats, a plurality of weaving cords which attach the plurality of slats together, a strap including a top end and a bottom end, the top end being attached to one of the plurality of slats at a back side of the shade and the bottom end being a free end, rolling up the shade to a first rolled up position, and securing the rolled up portion of the shade by wrapping the strap around the rolled up portion and securing the strap to a front side of the shade.

The shade may further include another strap, and the method may further include rolling up the shade to a second rolled up position without detaching the strap to form a new rolled up portion, and securing the new rolled up portion by wrapping the another strap around the new rolled up portion and securing the another strap to a front side of the shade.

In yet another aspect, a strap for attachment to a support cord of a shade for holding up a rolled up portion of the shade includes an elastic body having a top end with a top loop, a bottom end with a bottom loop, a top sew seam adjacent to the top end of the elastic body and forming the top loop, and a bottom sew seam adjacent to the bottom end of the elastic body and forming the bottom loop, a first connector comprising a first end with a slit removably receiving the top loop of the elastic body and a second end with a hook configured to be removably attached to the support cord of the shade, a second connector receiving the bottom loop of the elastic body and configured to be attached to the support cord of the shade, where a distance from the top sew seam of the elastic body to the top end of the elastic body is greater than a distance from bottom sew seam of the elastic body to the bottom end of the elastic body so that the top loop is larger than the bottom loop.

The second connector may include a ring for removably receiving the bottom loop of the elastic body and a clip for removably attaching to the support cord of the shade.

At least one of the first connector and the second connector may include at least one of a hook, an adhesive, hook and loop, a clip, or a button.

In yet another aspect, a fastener for attachment to a support cord of a shade for holding up a rolled up portion of the shade includes a main body including a top end, a bottom end, a right side, and a left side, and forming an elliptical shape with a vertical radius and a horizontal radius, the vertical radius being approximately four times the horizontal radius, a first cutout extending from the right side or the left side of the main body and towards the bottom end or the top end of the main body, the first cutout including a passageway which gradually narrows and ends with a wider circular hole to form a first hook in the main body, a second cutout extending from the right side or the left side of the main body and towards the bottom end or the top end of the main body, the second cutout including a passageway which gradually narrows and ends with a wider circular hole to form a second hook in the main body.

The fastener may be formed from acrylonitrile butadiene styrene plastic material.

The first cutout may extend from the left side and towards the bottom end, and the second cutout may extend from the right side and towards the top end.

The first cutout may extend from the left side and towards the bottom end, and the second cutout may extend from the left side and towards the top end.

A width of the passageway of the first cutout and a width of the passageway of the second cutout may be configured to be adjusted by bending the first hook or the second hook, respectively.

In yet another aspect, a fastener for attachment to a support cord of a shade for holding up a rolled up portion of the shade includes a first body portion having a top end, a bottom end, a right side, a left side, a pin, and a pair of track element, a second body portion includes a top end, a bottom end, a right side, a left side, an opening, and a pair of tracks, a first connector extending from the top end of the first body portion, and a second connector extending from the bottom end of the second body portion, where the first body portion and the second body portion are attached to one another by the pin being inserted through the opening, and the pair of track elements being inserted through the pair of tracks.

The first connector may be a first hook and the second connector may be a second hook, and the first hook and the second hook may be open from opposite sides of the fastener.

The fastener may further include a pair of elastic elements which are positioned within the pair of tracks.

A position of the first body portion with respect to the second body portion may be adjustable.

In yet another aspect, a storage strap for attachment to a support cord of a shade for holding up a rolled up portion of the shade includes an elastic body including a top end with a top loop, a bottom end with a bottom loop, a top sew seam adjacent to the top end of the elastic body and forming the top loop, and a bottom sew seam adjacent to the bottom end of the elastic body and forming the bottom loop, a first connector including a first end with a slit receiving the top loop of the elastic body and a second end with a hole configured to be removably attached to a top headrail, and a second connector receiving the bottom loop of the elastic body and configured to be attached to the support cord of the shade.

The first connector may have a shape of a large circular portion from which protrudes a smaller protrusion portion with the hole of the first connector being on the smaller protrusion portion and the slit of the first connector being on the large circular portion.

BRIEF DESCRIPTION OF THE DRAWINGS

The foregoing summary, as well as the following detailed description, will be better understood when read in conjunction with the appended drawings. For the purpose of illustration, certain examples of the present description are shown in the drawings. It should be understood, however, that the invention is not limited to the precise arrangements and instrumentalities shown. The accompanying drawings, which are incorporated in and constitute a part of this specification, illustrate an implementation of system, apparatuses, and methods consistent with the present description and, together with the description, serve to explain advantages and principles consistent with the invention.

Figures 1A, 1B, 1C, 1D:
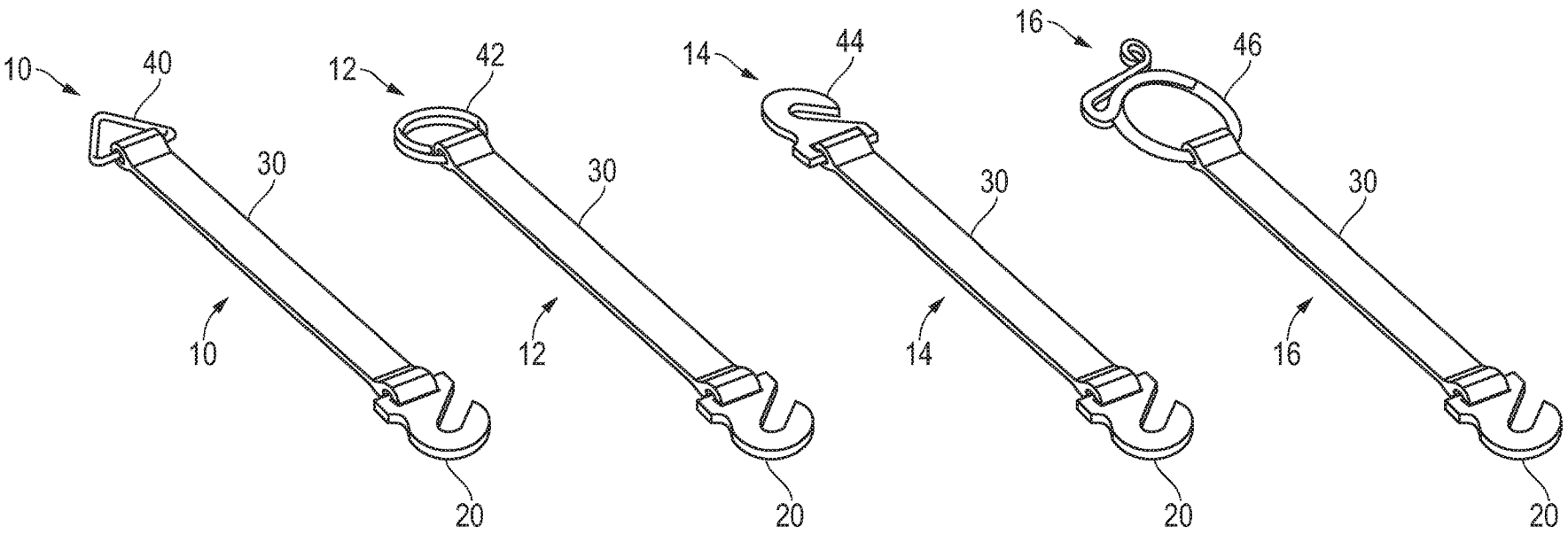
FIG. 1A is a diagram illustrating an example of a strap which may be permanently attached to a shade for holding the shade in a rolled up position.
FIG. 1B is a diagram illustrating an example of a strap which may be removably attached to a shade for holding the shade in a rolled up position.
FIG. 1C is a diagram illustrating another example of a strap which may be removably attached to a shade for holding the shade in a rolled up position.
FIG. 1D is a diagram illustrating yet another example of a strap which may be removably attached to a shade for holding the shade in a rolled up position.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the invention or the appended claims. Further, it should be understood that any one of the features can be used separately or in combination with other features. Other systems, methods, features, and advantages of the invention will be or become apparent to one with skill in the art upon examination of the detailed description. It is intended that all such additional systems, methods, features, and advantages be included within this description, be within the scope of the present invention, and be protected by the accompanying claims.

FIGS. 1A-1D are diagrams illustrating different examples of a strap 10, 12, 14, 16 which may be attached to a shade 100 for holding the shade 100 in a rolled up position. FIG. 1A is a diagram illustrating an example of a strap 10 which may be permanently attached to a shade 100 for holding the shade 100 in a rolled up position. FIG. 1B is a diagram illustrating an example of a strap 12 which may be removably attached to a shade 100 for holding the shade 100 in a rolled up position. FIG. 1C is a diagram illustrating another example of a strap 14 which may be removably attached to a shade 100 for holding the shade 100 in a rolled up position. FIG. 1D is a diagram illustrating yet another example of a strap 16 which may be removably attached to a shade 100 for holding the shade 100 in a rolled up position.

Referring to FIG. 1A, the strap 10 includes a first connector 20 which, in this example, is a hook but may include other connection mechanisms which may be detachable such as adhesives, hook and loop, clips, buttons, among other connection mechanisms. The strap 10 includes an elastic body 30 which may be flexible to allow movement from a free hanging, straight position to a wrapped, curved position. At the opposite end of the first connector 20 is a second connector 40 which, in this example, is a triangular permanent clip which may be permanently attached to the shade 100.

FIGS. 1B, 1C, and 1D show straps 12, 14, 16 with similar first connectors 20, and elastic bodies 30, but different second connectors 42, 44, 46. As illustrated in FIG. 1B, a strap 12 includes a second connector 42 which is similar to a key chain ring and is removably attachable to a shade 100. Another type of second connector 44 is a hook, as illustrated in FIG. 1C. This is similar to the hook of the first connector 20. Yet another type of second connector 46 is a ring with a projection which may be removably attached to a shade 100, as illustrated in FIG. 1D. The second connector 46 is described in more detail below and in reference with FIG. 12. A number of other connectors may be used for the second connectors 40, 42, 44, 46 which may be detachable or permanently attached to the shade such as adhesives, hook and loop, clips, buttons, among others.

FIGS. 2A-2D are diagrams illustrating different examples of a strap 110, 112, 114, 116 with a removable connector 400 which may be attached to a shade 100 for holding the shade 100 in a rolled up position. The removable connector 400 is capable of being detached at both ends; that is, from each of the straps and from the shade. The removable connector 400 is described in more detail below and in reference with FIGS. 14A-14C.

Figures 2A, 2B, 2C, 2D:
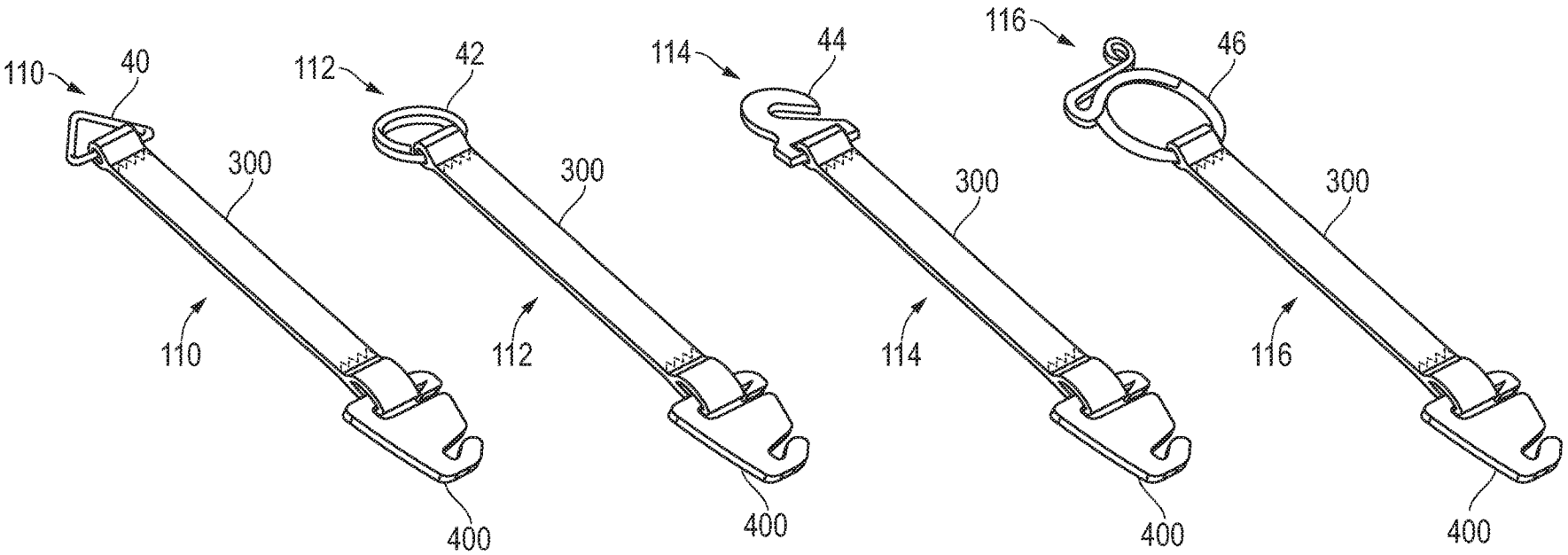
FIG. 2A is a diagram illustrating an example of a strap with a removable connector which may be permanently attached to a shade for holding the shade in a rolled up position.
FIG. 2B is a diagram illustrating an example of a strap with a removable connector which may be removably attached to a shade for holding the shade in a rolled up position.
FIG. 2C is a diagram illustrating another example of a strap with a removable connector which may be removably attached to a shade for holding the shade in a rolled up position.
FIG. 2D is a diagram illustrating yet another example of a strap with a removable connector which may be removably attached to a shade for holding the shade in a rolled up position.

FIG. 2A is a diagram illustrating an example of a strap 110 with a removable connector 400 which may be permanently attached to a shade 100 for holding the shade 100 in a rolled up position. FIG. 2B is a diagram illustrating an example of a strap 112 with a removable connector 400 which may be removably attached to a shade 100 for holding the shade 100 in a rolled up position. FIG. 2C is a diagram illustrating another example of a strap 114 with a removable connector 400 which may be removably attached to a shade 100 for holding the shade 100 in a rolled up position. FIG. 2D is a diagram illustrating yet another example of a strap 116 with a removable connector 400 which may be removably attached to a shade 100 for holding the shade 100 in a rolled up position.

Referring to FIG. 2A, the strap 110 includes a first connector 400 which, in this example, is a removable hook which is detachable from both the strap 110 and the shade 100. The first connector 400 may also include other connection mechanisms which may be detachable from the strap 110 and/or from the shade 100 such as adhesives, hook and loop, clips, buttons, among other connection mechanisms. The strap 110 includes an elastic body 300 which may be flexible to allow movement from a free hanging, straight position to a wrapped, curved position. The elastic body 300 includes sew seams to ensure stability of the first connector 400 and/or the second connector 40, 42, 44, 46 of each of the straps 110, 112, 114, 116. The elastic body 300 is described in more detail below and in reference with FIG. 11. At the opposite end of the first connector 400 is a second connector 40 which, in this example, is a triangular permanent clip which may be permanently attached to the shade 100.

FIGS. 2B, 2C, and 2D show straps 112, 114, 116 with similar first connectors 400, and elastic bodies 300, but different second connectors 42, 44, 46. As illustrated in FIG. 2B, a strap 112 includes a second connector 42 which is similar to a key chain ring and is removably attachable to a shade 100. Another type of second connector 44 is a hook, as illustrated in FIG. 2C. Yet another type of second connector 46 is a ring with a projection which is removably attachable to a shade 100, as illustrated in FIG. 2D. A number of other connectors may be used for the second connectors 40, 42, 44, 46 which may be detachable or permanently attached to the shade such as adhesives, hook and loop, clips, buttons, among others. It should also be appreciated that any iteration of the first and second connectors described may be combined on a single strap including, for example, two first connectors or two second connectors.

Figure 3:
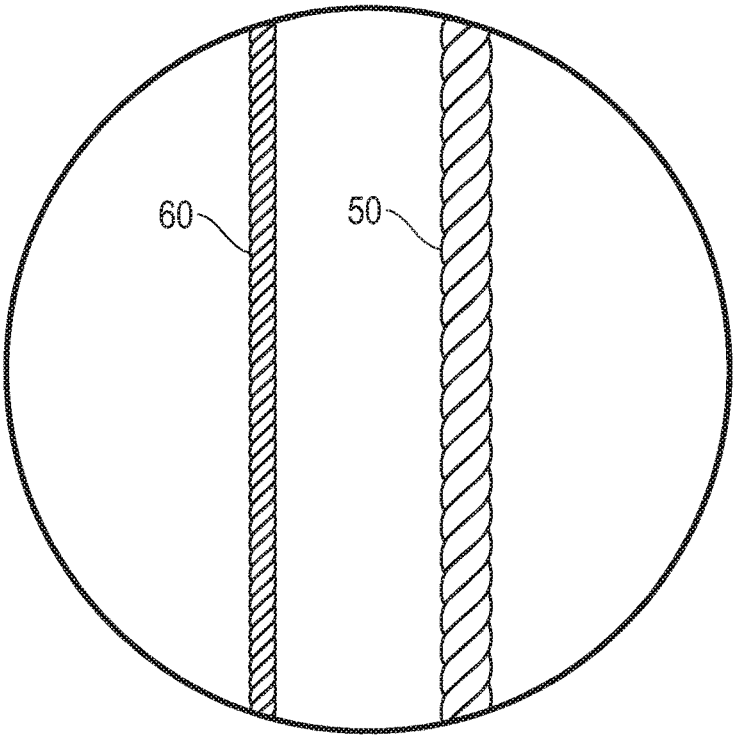
FIG. 3 is a diagram illustrating an example of a standard weaving cord and a support cord side by side.

FIG. 3 is a diagram illustrating an example of a standard weaving cord 60 and a support cord 50 side by side.

Referring to FIG. 3, a support cord 50 may be thick enough to be used as a supporting member of a shade 100 for carrying a strap 10, 12, 14, 16, 110, 112, 114, 116, or for carrying other fasteners as described further below, and a rolled up portion of the shade 100. Both the support cord 50 and the typical weaving cord 60 may be used to attach the slats of the shade 100 to one another. The typical weaving cord 60 may be thinner than the support cord 50. In a preferred example, the weaving cord 60 is thinner than the support cord 50 by a fraction of about $1/3$.

Figure 4:
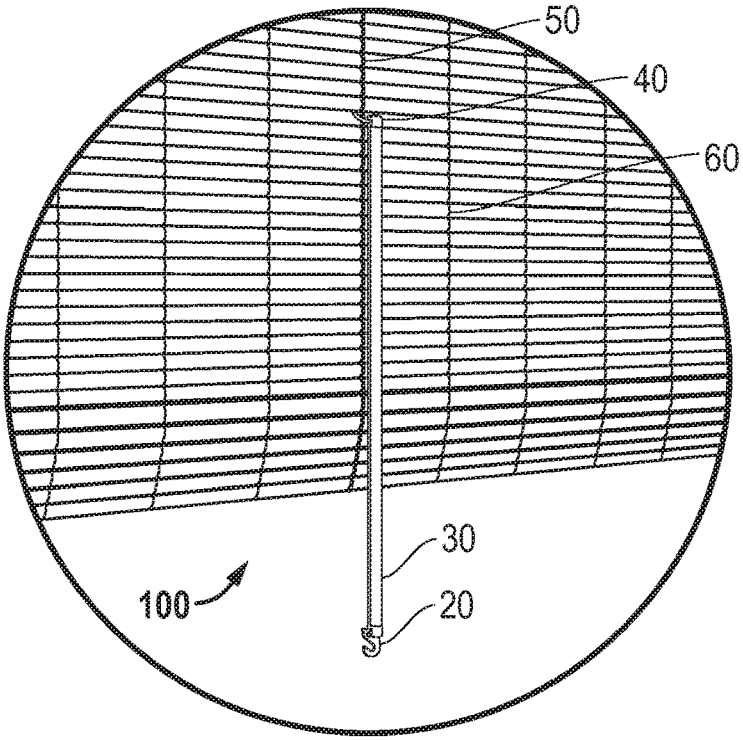
FIG. 4 is a diagram illustrating an example of the strap according to FIGS. 1A-1D attached to the support cord at the back of the shade.

FIG. 4 is a diagram illustrating an example of the strap 10, 12, 14, 16 of FIGS. 1A-1D attached to the support cord at the back of the shade. In this example, the strap 10 of FIG. 1A is shown attached but any of the straps 10, 12, 14, 16 may be used.

Referring to FIG. 4, the second connector 40 may be removably or irremovably attached to the shade 100. In a preferred example, the second connector 40 is attached to the support cord 50 of the shade 100 between slats. The elastic body 30 and the first connector 20 of the strap 10 may be free hanging at the back of the shade 100. The weaving cords 60 may be adjacent to the support cord 50 with at least one weaving cord at each side of the support cord 50. The weaving cord 60 may be thinner than the support cord 50 by a fraction of: $1/12$, $1/11$, $2/11$, $3/11$, $4/11$, $1/10$, $3/10$, $7/10$, $9/10$, $1/9$, $2/9$, $4/9$, $5/9$, $7/9$, $8/9$, $1/8$, $3/8$, $5/8$, $7/8$, $1/7$, $2/7$, $3/7$, $4/7$, $5/7$, $6/7$, $1/6$, $5/6$, $1/5$, $2/5$, $3/5$, $4/5$, $1/4$, $3/4$, $1/3$, $2/3$, $1/2$, at least $1/12$, at least $1/11$, at least $2/11$, at least $3/11$, at least $4/11$, at least $1/10$, at least $3/10$, at least $7/10$, at least $9/10$, at least $1/9$, at least $2/9$, at least $4/9$, at least $5/9$, at least $7/9$, at least $8/9$, at least $1/8$, at least $3/8$, at least $5/8$, at least $7/8$, at least $1/7$, at least $2/7$, at least $3/7$, at least $4/7$, at least $5/7$, at least $6/7$, at least $1/6$, at least $5/6$, at least $1/5$, at least $2/5$, at least $3/5$, at least $4/5$, at least $1/4$, at least $3/4$, at least $1/3$, at least $2/3$, at least $1/2$, at most $1/12$, at most $1/11$, at most $2/11$, at most $3/11$, at most $4/11$, at most $1/10$, at most $3/10$, at most $7/10$, at most $9/10$, at most $1/9$, at most $2/9$, at most $4/9$, at most $5/9$, at most $7/9$, at most $8/9$, at most $1/8$, at most $3/8$, at most $5/8$, at most $7/8$, at most $1/7$, at most $2/7$, at most $3/7$, at most $4/7$, at most $5/7$, at most $6/7$, at most $1/6$, at most $5/6$, at most $1/5$, at most $2/5$, at most $3/5$, at most $4/5$, at most $1/4$, at most $3/4$, at most $1/3$, at most $2/3$, at most $1/2$. In a preferred example, the thickness of the support cord is 0.063 inches but any thickness may be used.

Figure 5:
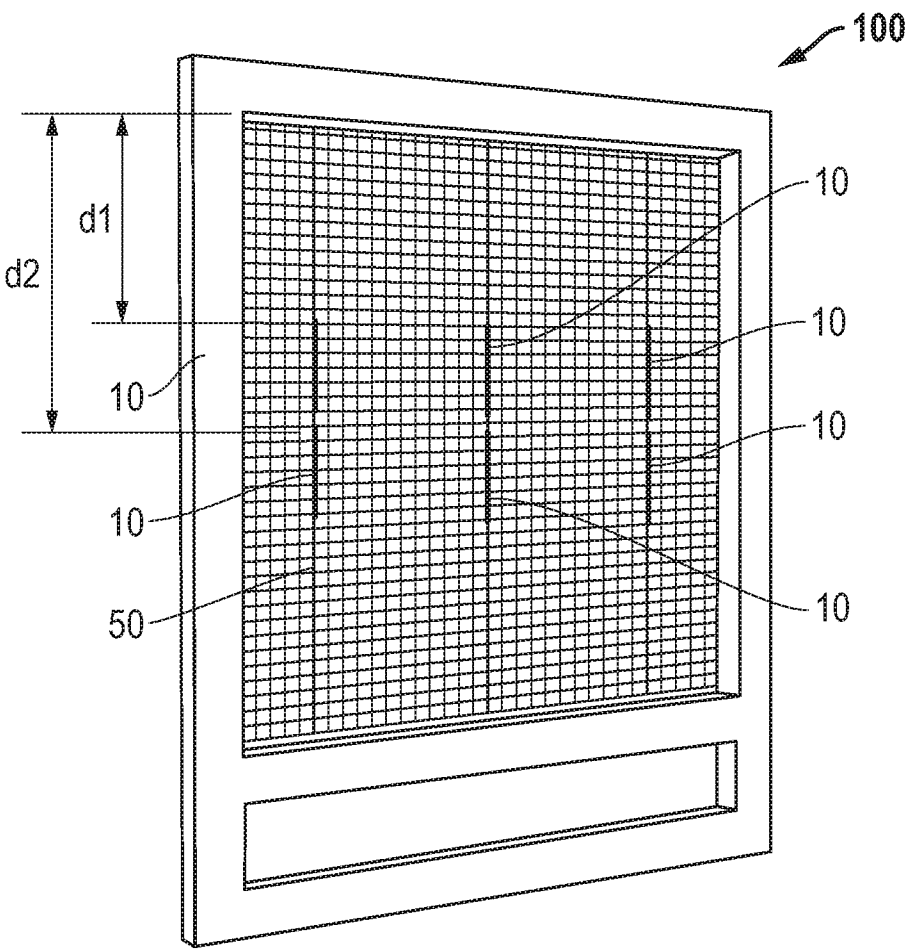
FIG. 5 is a diagram illustrating an example of the shade having six straps attached thereto.

FIG. 5 is a diagram illustrating an example of the shade 100 having six straps 10 attached thereto.

Referring to FIG. 5, the shade 100 is shown from its back side. There are multiple arrangements of weaving cords 60, support cords 50, and straps 10 that are provided. Only an example is illustrated in the figures, but a number of different examples are envisioned. According to FIG. 4, about thirty weaving cords 60, three support cords 50, and six straps 10 are arranged on a shade 100. The support cords 50 are arranged so that there are about five weaving cords 60 between each side of the shade 100 and a support cord 50, and ten weaving cords between each support cord 50. All of the weaving cords 60 and support cords 50 are about equally spaced, but the spacing may vary.

While there are three support cords 50 illustrated in this example, a number of different examples may be followed. The support cords 50 may include one, two, three, four, five, at least one, at least two, at least three, at least four, at least five, at most one, at most two, at most three, at most four, or at most five. In the preferred example, forty eight inch long shades will have two support cords 50, and the sixty inch to 120 inch long shades will have three support cords 50. While not preferred, in some example, a support cord 50 is not used and one or more straps 10 are attached to weaving cords 60. While the support cords 50 illustrated are spaced according to one example, a number of different examples may be followed. The support cords 50 may be spaced at equal intervals or unequal intervals of a fraction of a total width of the shade 100 including: 1/12, 1/11, 2/11, 3/11, 4/11, 1/10, 3/10, 7/10, 9/10, 1/9, 2/9, 4/9, 5/9, 7/9, 8/9, 1/8, 3/8, 5/8, 7/8, 1/7, 2/7, 3/7, 4/7, 5/7, 6/7, 1/6, 5/6, 1/5, 2/5, 3/5, 4/5, 1/4, 3/4, 1/3, 2/3, 1/2, at least 1/12, at least 1/11, at least 2/11, at least 3/11, at least 4/11, at least 1/10, at least 3/10, at least 7/10, at least 9/10, at least 1/9, at least 2/9, at least 4/9, at least 5/9, at least 7/9, at least 8/9, at least 1/8, at least 3/8, at least 5/8, at least 7/8, at least 1/7, at least 2/7, at least 3/7, at least 4/7, at least 5/7, at least 6/7, at least 1/6, at least 5/6, at least 1/5, at least 2/5, at least 3/5, at least 4/5, at least 1/4, at least 3/4, at least 1/3, at least 2/3, at least 1/2, at most 1/12, at most 1/11, at most 2/11, at most 3/11, at most 4/11, at most 1/10, at most 3/10, at most 7/10, at most 9/10, at most 1/9, at most 2/9, at most 4/9, at most 5/9, at most 7/9, at most 8/9, at most 1/8, at most 3/8, at most 5/8, at most 7/8, at most 1/7, at most 2/7, at most 3/7, at most 4/7, at most 5/7, at most 6/7, at most 1/6, at most 5/6, at most 1/5, at most 2/5, at most 3/5, at most 4/5, at most 1/4, at most 3/4, at most 1/3, at most 2/3, at most 1/2.

Still referring to FIG. 5, the straps 10 may be arranged at a number of different positions. In a preferred example, the straps 10 are attached to the support cords 50. The straps 10 may be attached at more than one position along the length of the shade 100. In this example, the straps 10 are arranged so that two straps are on each support cord 50 one of which is attached at a length d1 which is about 1/4 a total length of the shade away from a top end of the shade and another which is attached at a length d2 which is about 3/8 a total length of the shade away from the top end of the shade. Thus, for a shade that is 8 feet (96 inches) long, the straps are attached at a length d1 that is 24 inches and a length d2 that is 36 inches. However, the straps 10 may be spaced at equal intervals or unequal intervals of a fraction of a total length of the shade 100 including: 1/12, 1/11, 2/11, 3/11, 4/11, 1/10, 3/10, 7/10, 9/10, 1/9, 2/9, 4/9, 5/9, 7/9, 8/9, 1/8, 3/8, 5/8, 7/8, 1/7, 2/7, 3/7, 4/7, 5/7, 6/7, 1/6, 5/6, 1/5, 2/5, 3/5, 4/5, 1/4, 3/4, 1/3, 2/3, 1/2, at least 1/12, at least 1/11, at least 2/11, at least 3/11, at least 4/11, at least 1/10, at least 3/10, at least 7/10, at least 9/10, at least 1/9, at least 2/9, at least 4/9, at least 5/9, at least 7/9, at least 8/9, at least 1/8, at least 3/8, at least 5/8, at least 7/8, at least 1/7, at least 2/7, at least 3/7, at least 4/7, at least 5/7, at least 6/7, at least 1/6, at least 5/6, at least 1/5, at least 2/5, at least 3/5, at least 4/5, at least 1/4, at least 3/4, at least 1/3, at least 2/3, at least 1/2, at most 1/12, at most 1/11, at most 2/11, at most 3/11, at most 4/11, at most 1/10, at most 3/10, at most 7/10, at most 9/10, at most 1/9, at most 2/9, at most 4/9, at most 5/9, at most 7/9, at most 8/9, at most 1/8, at most 3/8, at most 5/8, at most 7/8, at most 1/7, at most 2/7, at most 3/7, at most 4/7, at most 5/7, at most 6/7, at most 1/6, at most 5/6, at most 1/5, at most 2/5, at most 3/5, at most 4/5, at most 1/4, at most 3/4, at most 1/3, at most 2/3, at most 1/2.

Figure 6:
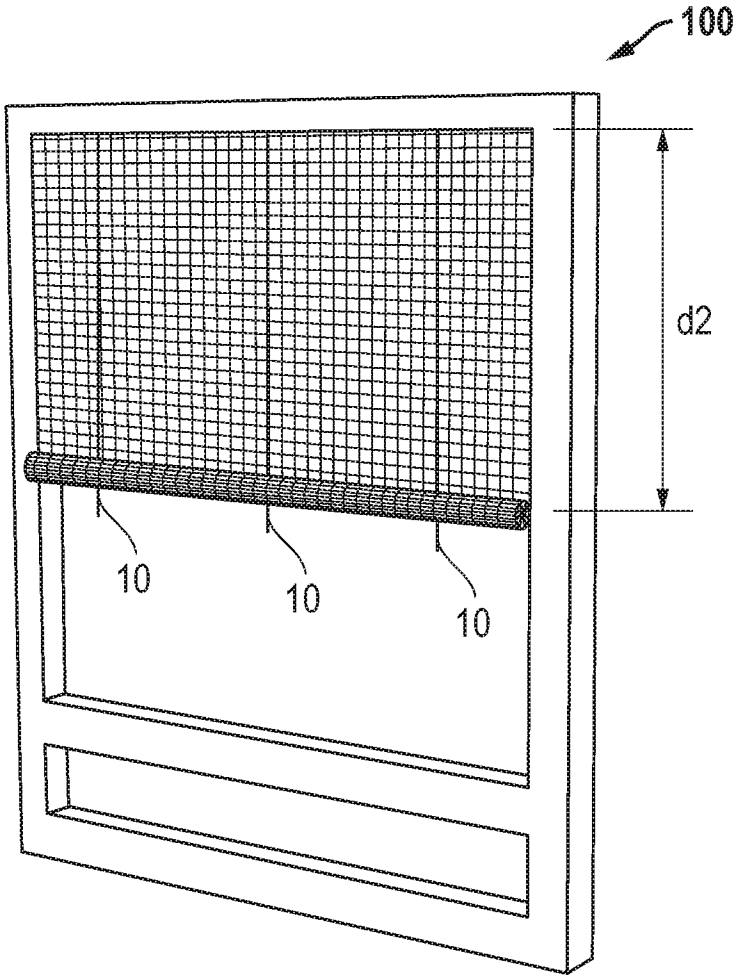
FIG. 6 is a diagram illustrating an example of the shade while being rolled up.

FIG. 6 is a diagram illustrating an example of the shade while being rolled up.

Figure 9:
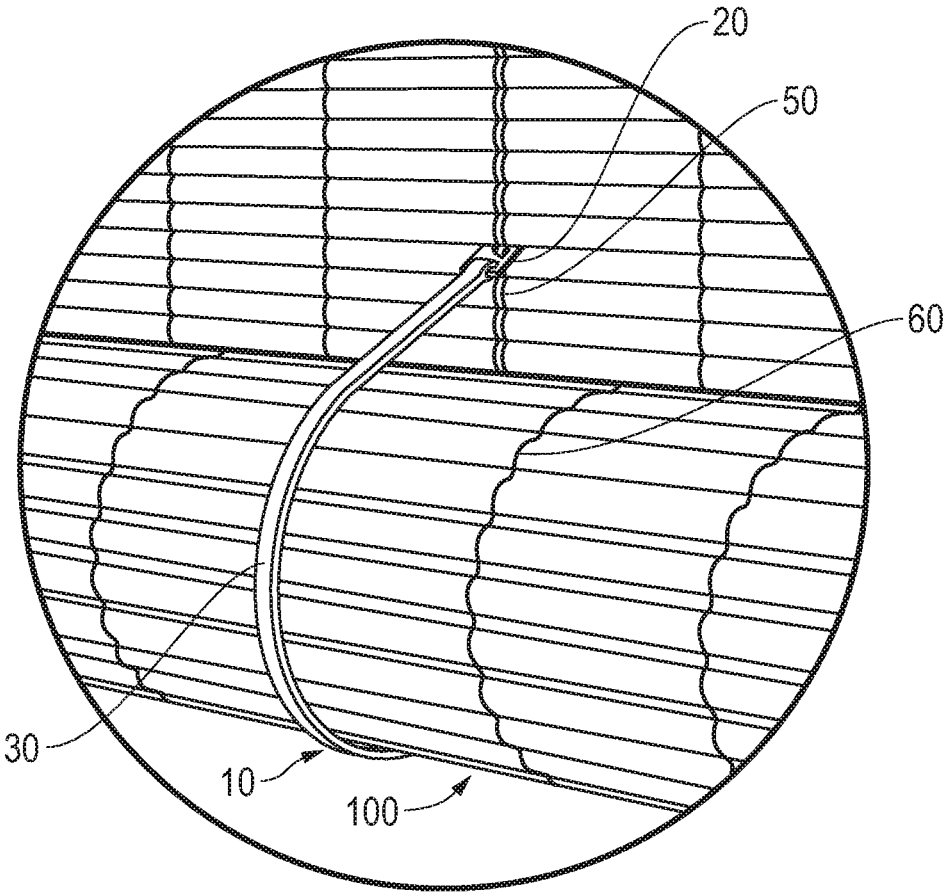
FIG. 9 is a diagram illustrating an example of the strap according to FIGS. 1A-1D attached to the support cord at the front of the shade.

Referring to FIG. 6, the shade 100 is shown prior to being held in position by the straps 10 from a front side. That is, while the shade 100 is being rolled up by a user, the straps 10 become visible or exposed from a front side of the shade 100 as the user rolls the shade up to a length d2. A user may wrap each of the straps 10 around the rolled up portion of the shade 100 to extend from the back side to the front side, and secure the straps 10 to the front side at the support cord 10. To more closely illustrate how the straps 10 are secured to the front side, reference is made to FIG. 9. FIG. 9 illustrates an example of the strap 10 attached to the support cord 50 at the front of the shade 100. The elastic body 30 of the strap 10 wraps around the bottom of the rolled up portion of the shade 100 and the first connector 20 attaches or hooks into the support cord 50 between two slats.

Figure 8:
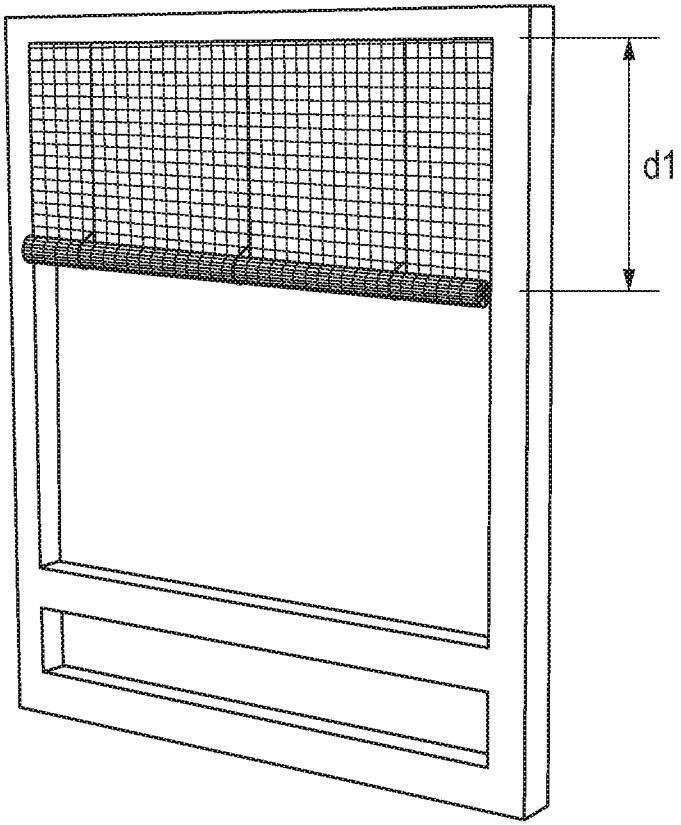
FIG. 8 is a diagram illustrating an example of the shade in a second rolled up position.
Figure 7:
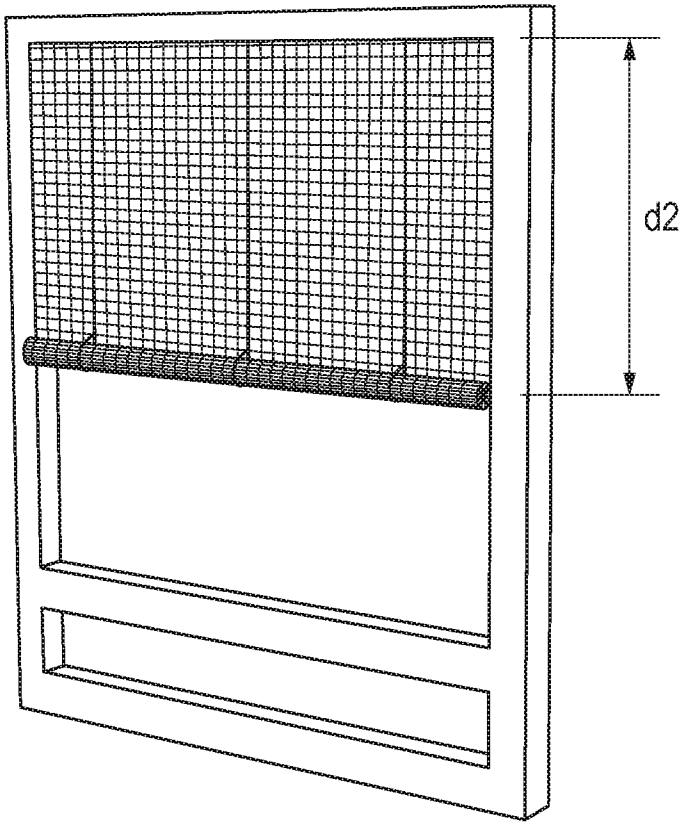
FIG. 7 is a diagram illustrating an example of the shade in a first rolled up position.

FIG. 7 is a diagram illustrating an example of the shade in a first rolled up position after the straps 10 are secured. Once the straps 10 are secured to the front of the shade 100, the shade 100 stays up at a length d2. If a user wishes to shorten the length of the shade 100, they may continue rolling the shades after undoing or without undoing the straps 10 which were already secured 100. Once the next length is reached, which in this example is d1, the next set of straps 10 will be exposed and can be secured. FIG. 8 is a diagram illustrating an example of the shade in a second rolled up position after the straps 10 are secured. Once the straps 10 are secured to the front of the shade 100, the shade 100 stays up at a length d1. Of course, a number of held-in-place positions are possible for the shade 100 based on the number and position of straps 10.

While the shade 100 and arrangement of straps 10 are shown in FIGS. 6-9 with only strap 10 for ease of illustration, it should be appreciated that the same arrangements and the same shade 100 can also be used with any of the straps 12, 14, 16, 110, 112, 114, 116 described in FIGS. 1B-1D and FIGS. 2A-2D. In addition, the same arrangements and shade 100 can also be used with any of the other fasteners described in more detail below.

Figure 10B:
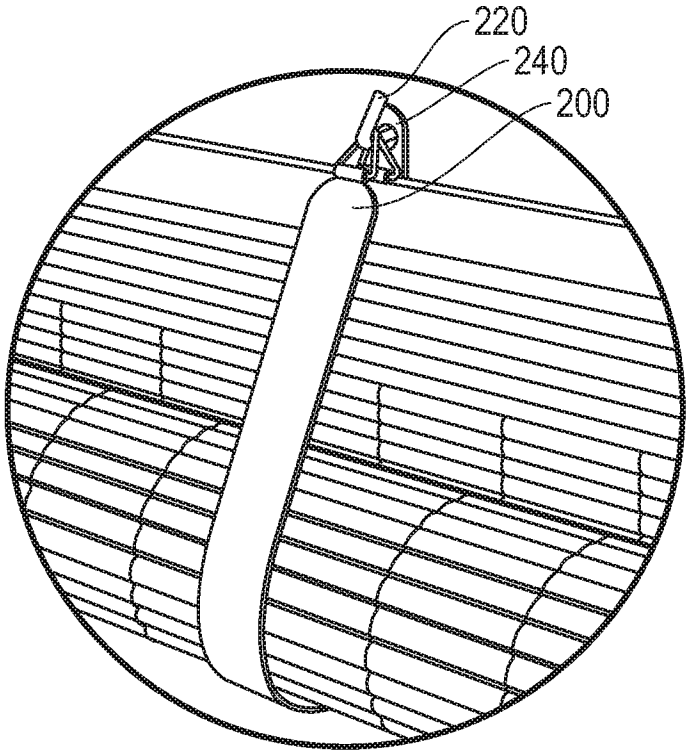
FIGS. 10A and 10B are diagrams illustrating an example of a stow away storage strap for securing the shade in a storage position.
Figure 10A:
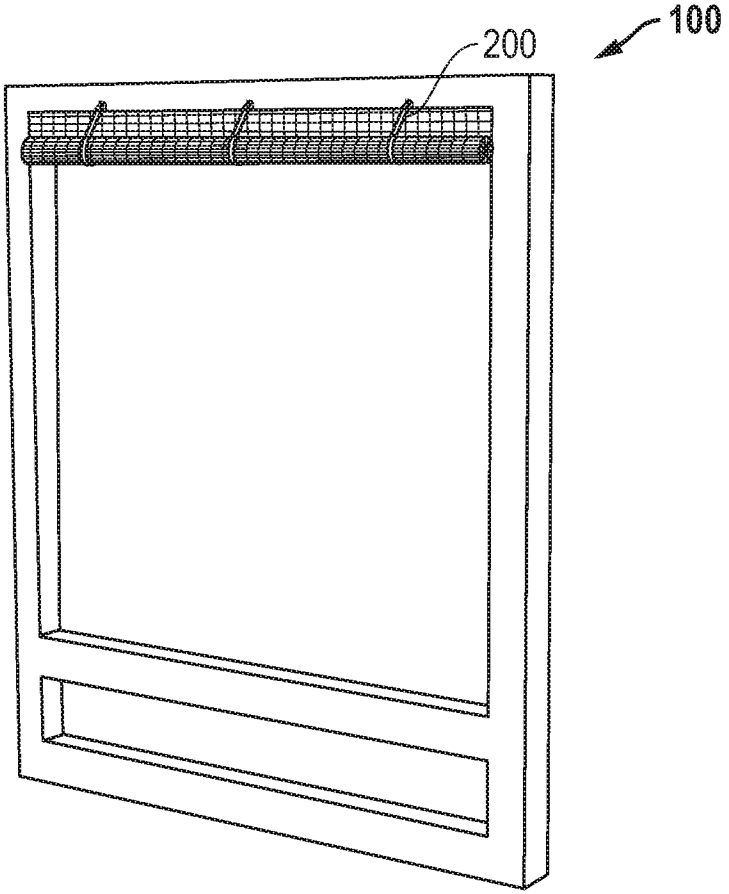

FIG. 10 is a diagram illustrating an example of a stow away storage strap 200 for securing the shade 100 in a storage position. At a higher position along the shade 100, a storage strap 200 may be removably or irremovably secured to the back of the shade 100, similar to the way that the strap 10 is secured and using a similar connector as the second connector 40. The storage straps may have a first connector 220 which is similar to the first connector 20 of the strap 10, and which hooks or attaches in a similar way to a corresponding connector 240 on the front side of the top headrail. The storage strap 200 may secure the shade 100 all the way up and may include a heavy duty and thicker strap 200 and connector 220 than the strap 10. This provides optimal storage during off-season and is an optional strap that may be used with the shade 100.

An overview of using the shade 100 and straps 10, 12, 14, 16, 110, 112, 114, 116, may include: step A: shade 100 hangs in full down position; step B: user stands at middle point of shade 100 that has a noticeable thicker support cord 50 in position and gently rolls up the shade to position 1 or 2, and they can continually roll to the secondary position without removing the first row of straps 10, 12, 14, 16, 110, 112, 114, 116; step C: a strap 10, 12, 14, 16, 110, 112, 114, 116 is then attached to the thicker thread at position 1 or 2; step D: optional storage at highest position, the user roll-ups up the shade all the way to the top and using the storage strap 200 attaches to ring on top headrail.

Figure 11:
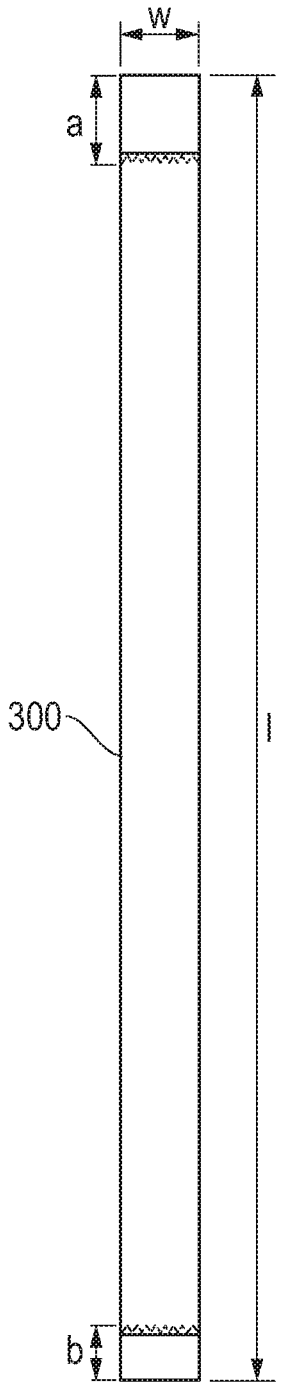
FIG. 11 is a diagram illustrating an example of the elastic body used in the straps of FIGS. 2A-2D.

FIG. 11 is a diagram illustrating an example of the elastic body 300 used in the straps 110, 112, 114, 116 of FIGS. 2A-2D. Referring to FIG. 11, the elastic body 300 may be made from a flexible PE vinyl material. However, any elastic material may be used as is known to a person having ordinary skill in the art. On each end of the elastic body 300, a seam may be sewed with enough space for each of the connectors on opposite sides of the elastic body 300. In a preferred example, the seam which is sewed on the side of the first connector 20, 400 is sewed farther from the end of the elastic body 300 than the seam which is sewed on the side of the second connector 40, 42, 44, 46 especially when the first connector 20, 400 is the removable first connector 400. This provides enough space for the removable first connector 400 to be inserted into and removed from the elastic body 300 while the second connector 40, 42, 44, 46 is tightly secured on the other end of the elastic body 300.

Figure 12:
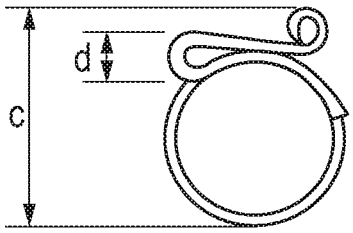
FIG. 12 is a diagram illustrating an example of the connector used in the straps of FIGS. 1D and 2D.

FIG. 12 is a diagram illustrating an example of the connector 46 used in the straps of FIGS. 1D and 2D. Referring to FIG. 12, the connector 46 may be a galvanized metal wire connector. The connector 46 is preferably removable from the elastic body 30, 300 for adjustment and includes a projection section or clip which allows the connector 46 to be clipped onto the shade 100 or cords of the shade 100. In a preferred example, the connector 46 includes a loop end to eliminate any sharp edges which may injure a user, and the clip includes a slight opening to easily remove on and off. In this example, the inner diameter of the ring is about 0.62 inches, which is preferred to that a strap can fit within the ring. The wire thickness is preferred to be about 0.035 inches, the axial length c of the connector 46 is preferred to be about 0.86 inches, and the length of the projection section on one side of the connector 46 is preferred to be about 0.14 inches. It should be appreciated that any dimensions may be used and the dimensions described are only examples.

Figure 13A:
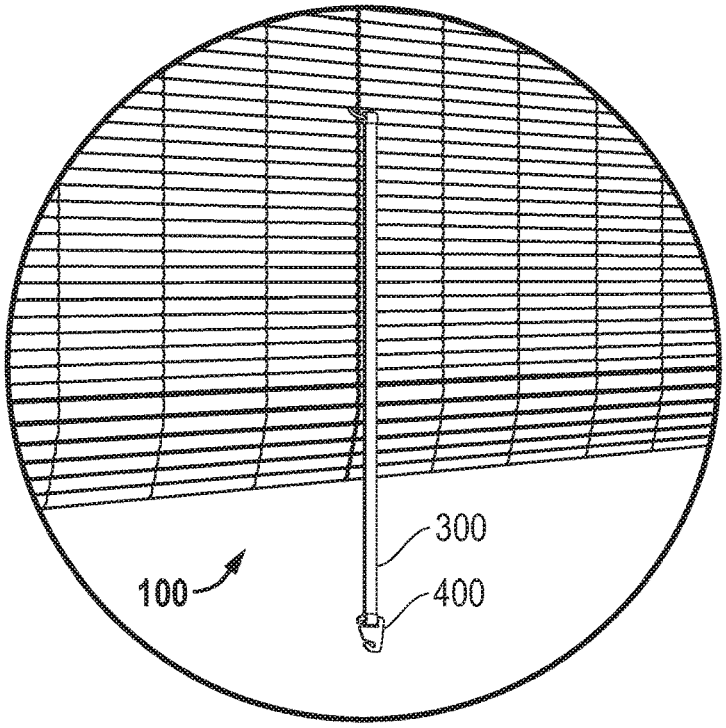
FIG. 13A is a diagram illustrating an example of the strap according to FIGS. 2A-2D attached to the support cord at the back of the shade.
Figure 13B:
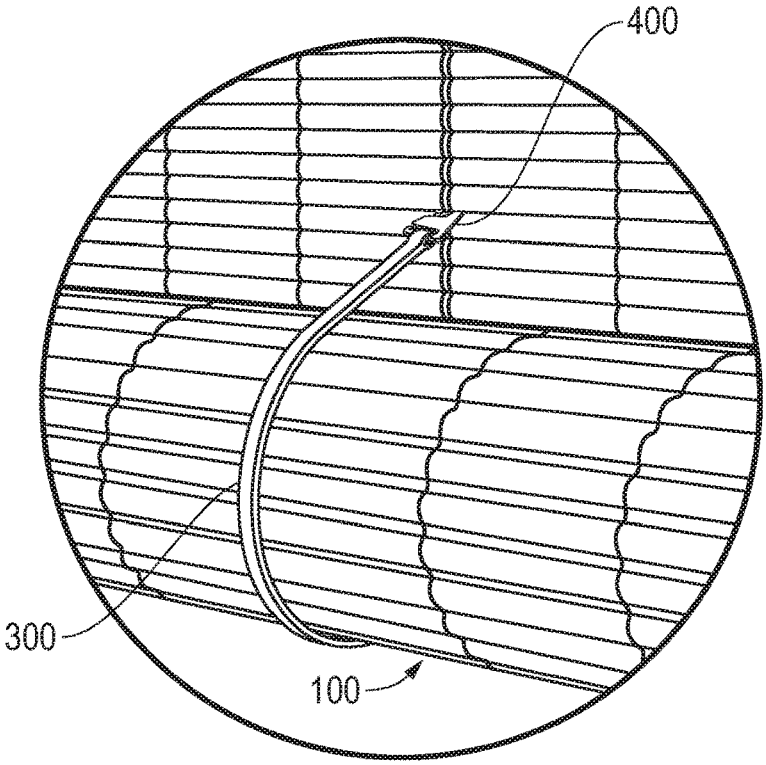
FIG. 13B is a diagram illustrating an example of the strap according to FIGS. 2A-2D attached to the support cord at the front of the shade.

FIG. 13A is a diagram illustrating an example of the strap 110, 112, 114, 116 according to FIGS. 2A-2D attached to the support cord 50 at the back of the shade 100. FIG. 13B is a diagram illustrating an example of the strap 110, 112, 114, 116 according to FIGS. 2A-2D attached to the support cord 50 at the front of the shade and holding up a rolled up portion of the shade 100. Similar to the illustrations shown in FIGS. 4-9, respectively, where the strap 10, 12, 14, 16 is used to secure a rolled up portion of the shade, the same approach may be used to secure the shade 100 using the strap 110, 112, 114, 116, as illustrated in FIGS. 13A and 13B.

Figure 14A:
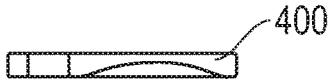
FIGS. 14A, 14B, and 14C are diagrams illustrating an example of the removable connector used in the straps of FIGS. 2A-2D.
Figure 14B:
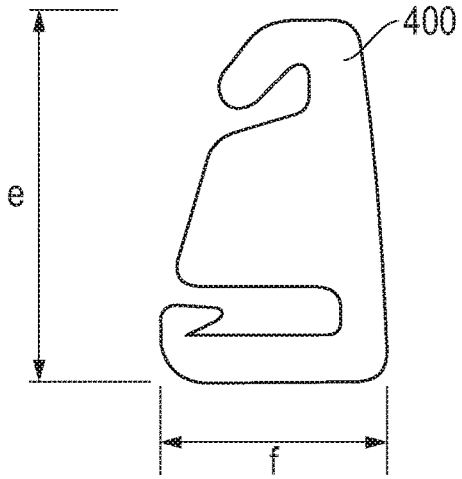
Figure 14C:
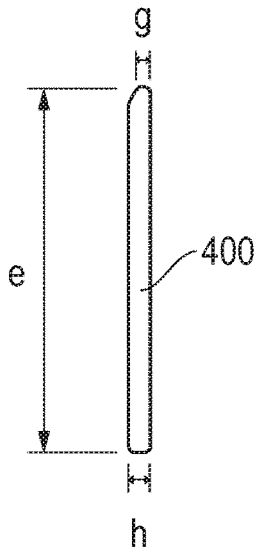

FIGS. 14A, 14B, and 14C are diagrams illustrating an example of the removable connector 400 used in the straps 110, 112, 114, 116 of FIGS. 2A-2D. Referring to FIG. 14A, a top view of the connector 400 is illustrated. The connector 400 may be made from a solid ABS plastic; however, any other material may also be used as is known by a person having ordinary skill in the art. Referring to FIGS. 14B and 14C, a front view and a side view of the connector 400 is illustrated, respectively. The connector 400 may be open with a hook-like projection on one end and a slot on the other end, with the hook end capable of securing blinds in place using a thicker cord and the slot capable of receiving an elastic body 30, 300 as described throughout this application. The connector 400 is designed for easy assembly. In a preferred example, the connector 400 has an axial length e of 1.48 inches, a width f of 0.90 inches, and a thickness h of 0.08 inches with a flat portion g which is 0.04 inches long. It should be appreciated that any dimensions may be used and the dimensions described are only examples.

Figure 15C:
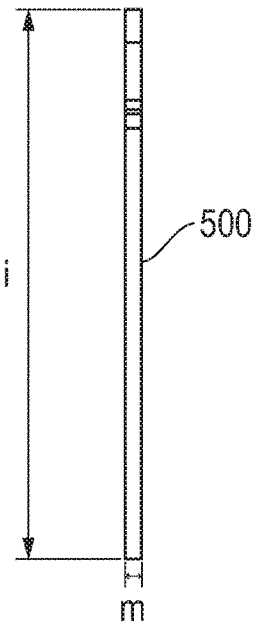
FIGS. 15A, 15B, 15C, and 15D are diagrams illustrating an example of a fastener which may be removably attached to a shade for holding the shade in a rolled up position.
Figure 15D:
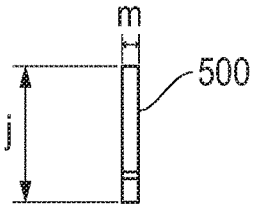
Figure 15A:
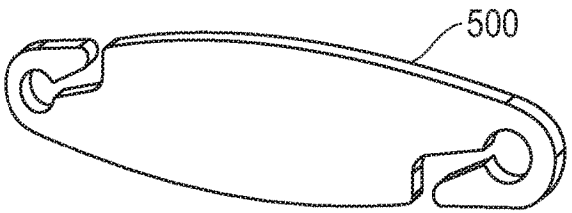

FIGS. 15A, 15B, 15C, and 15D are diagrams illustrating an example of a fastener 500 which may be removably attached to a shade for holding the shade in a rolled up position. Referring to FIG. 15A, a perspective view of the fastener 500 is illustrated. The fastener 500 may be formed of a solid body which may be at least partially inflexible but may have a level of flexibility. For example, the fastener 500 may be made of a plastic, polymer, or rubber material, among other materials which are known to a person having ordinary skill in the art. In a preferred example, the fastener 500 is at least less flexible than the elastic body 30, 300 of the straps 10, 12, 14, 16, 110, 112, 114, 116 described above.

Figure 15B:
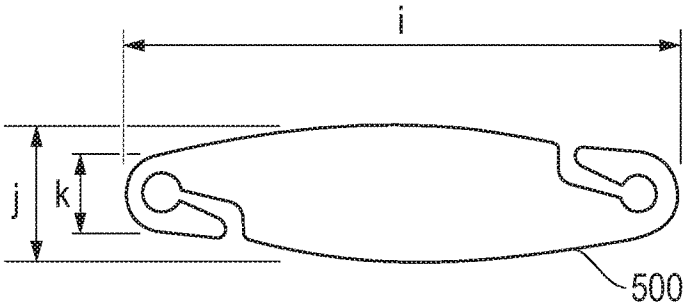

Referring to FIG. 15B, a front view of the fastener 500 is illustrated. The fastener may include hook-like ends which open to opposite sides of the fastener 500. In this example, the preferred dimensions include an axial length i of about 66.67 mm, a width j of about 16.29 mm, and a width k of the outer curve of each hook portion of about 9.38 mm. Referring to FIGS. 15C and 15D, a side view and a top view are illustrated, respectively. The preferred dimensions also include a thickness m of about 1.75 mm. Also, the inner radii of the rings inside each hook is about 2.13 mm, and the radii of the outer curve of each hook is 4.79 mm. The length of the slit for each fastener 500 is about 2.08 mm. It should be appreciated that any dimensions may be used and the dimensions described are only examples.

Still referring to FIGS. 15A-15B, the fastener 500 includes a main body which includes a top end, a bottom end, a right side, and a left side. The main body forms an elliptical shape with a vertical radius and a horizontal radius, the vertical radius being approximately four times the horizontal radius, a first cutout extends from the right side of the main body and towards the bottom end to form a passageway which gradually narrows and ends with a wider circular hole to form a first hook in the main body. A second cutout extending from the left side of the main body and towards the top end of the main body to form a passageway which gradually narrows and ends with a wider circular hole to form a second hook in the main body.

Figure 16:
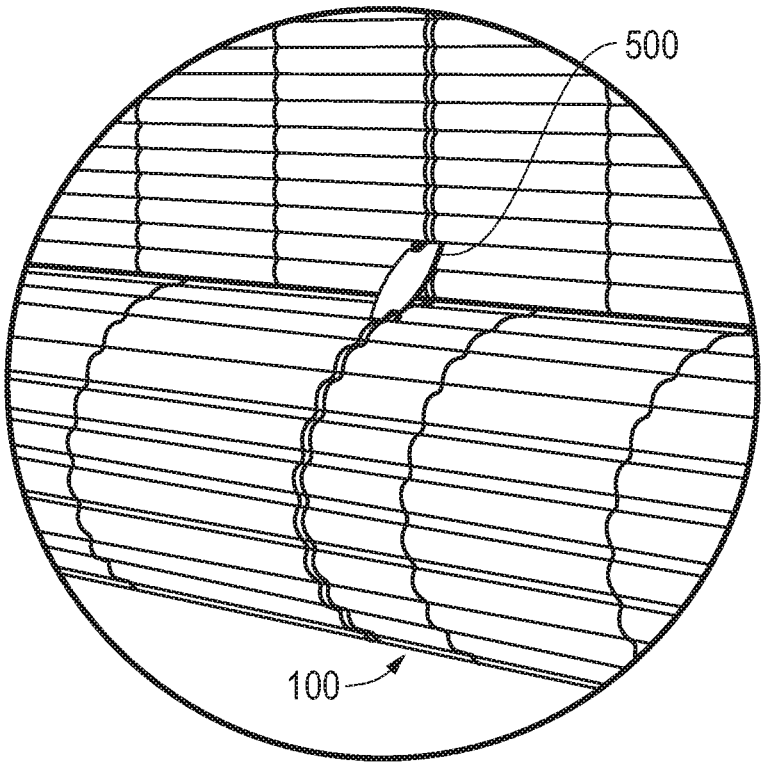
FIG. 16 is a diagram illustrating an example of the fastener in FIGS. 15A-15D as used to hold up the shade in a rolled up position.
Figure 17:
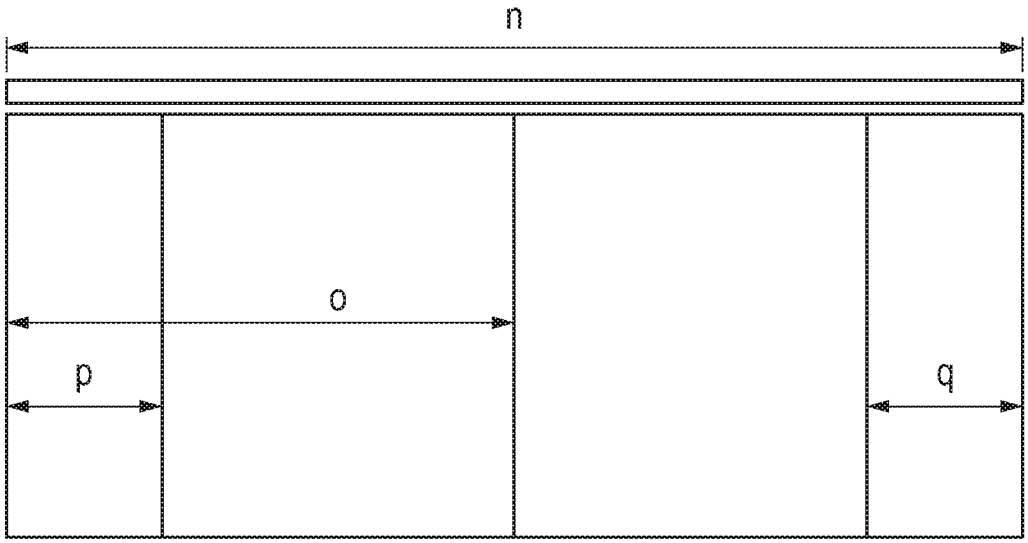
FIG. 17 is a diagram illustrating an example of placement of support cords on the shade.

FIG. 16 is a diagram illustrating an example of the fastener 500 in FIGS. 15A-15D as used to hold up the shade 100 in a rolled up position. Referring to FIG. 16, the fastener 500 may be used in a way similar to the straps 10, 12, 14, 16, 110, 112, 114, 116 as described above. That is, one end of the fastener 500 may be hooked onto a support cord 50 on the back of the shade 100 and, after the shade is rolled up from the front side, the other end of the fastener 500 may be hooked onto another part of the support cord 50 to hold up the rolled up portion of the shade 100. Referring to FIG. 17, an example of the spacing between support cords 50 is provided with a shade having a width of about 72 inches. In this example, a first support cord 50 is positioned a distance p of 17 inches from an end of the shade 100, a second support cord 50 is positioned a distance o of 37 inches from the end of the shade 100, and a third support cord 50 is positioned a distance q of 17 inches from an opposite end of the shade 100.

Figure 18A:
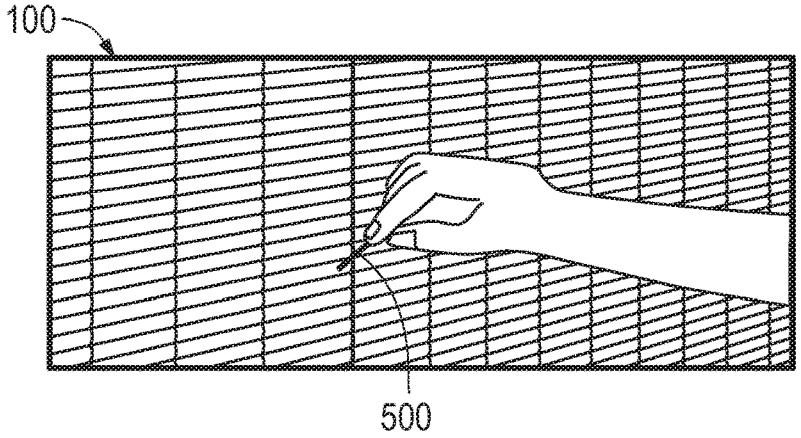
FIGS. 18A, 18B, and 18C are diagrams illustrating an example of positioning the fastener of FIGS. 15A-15D at the back of the shade, rolling up the shade from the front until the fastener is reached, and securing the fastener at the front of the shade, respectively.
Figure 18B:
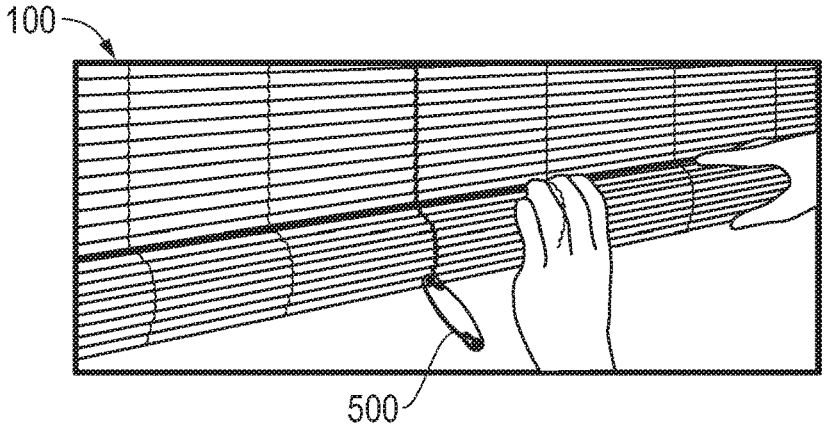
Figure 18C:
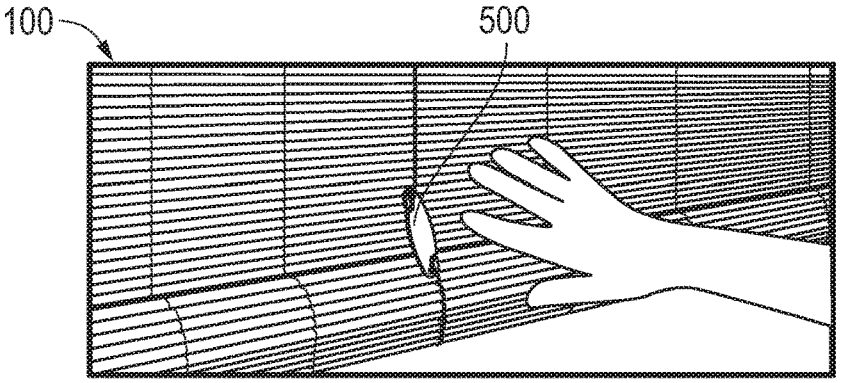

FIGS. 18A, 18B, and 18C are diagrams illustrating an example of positioning the fastener of FIGS. 15A-15D at the back of the shade, rolling up the shade from the front until the fastener is reached, and securing the fastener at the front of the shade, respectively. An overview of using the shade 100 and fastener 500, may include: step A: shade 100 hangs in full down position; step B: user attaches fastener 500 while standing in front of or behind the shade 100 so that the fastener 500 is hanging behind the shade 100; step C: user stands at middle point of shade 100 that has a noticeable thicker support cord 50 in position and gently rolls up the shade; step D: once the fastener 500 is reached and rolled up, as shown in FIG. 18B, the fastener 500 is then attached to the thicker thread from the front to hold up the rolled up portion of the shade 100, as shown in FIG. 18C; step E: optional storage at highest position, the user roll-ups up the shade all the way to the top and using the storage strap 200 attaches to ring on top headrail.

Figure 19C:
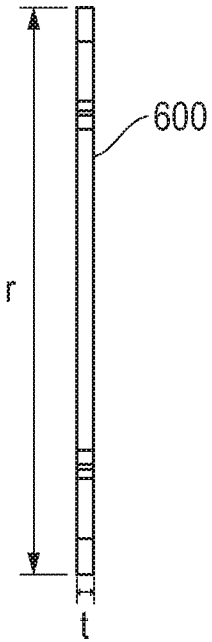
FIGS. 19A, 19B, and 19C are diagrams illustrating another example of a fastener which may be removably attached to a shade for holding the shade in a rolled up position.
Figure 19B:
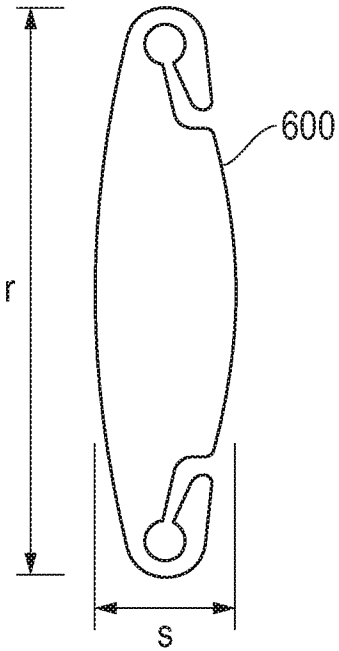
Figure 19A:
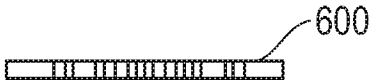

FIGS. 19A, 19B, and 19C are diagrams illustrating another example of a fastener 600 which may be removably attached to a shade 100 for holding the shade 100 in a rolled up position. Referring to FIG. 19A a top view of the fastener 600 is illustrated, and in FIG. 19B, a front view of the fastener is illustrated. The fastener 600 may include hook-like ends which open to the same sides of the fastener 600. Unlike the fastener 500 of FIGS. 15A-15D, the fastener 600 has hooks which open to the same side. This allows a user to quickly secure the fastener 600 to a support cord while at the same time providing a more secure mechanism for holding up the rolled up portion of the shade 100. In this example, the preferred dimensions include an axial length r of about 2.62 inches, a width s of about 0.65 inches, and a thickness t of about 0.08 inches.

Figure 20:
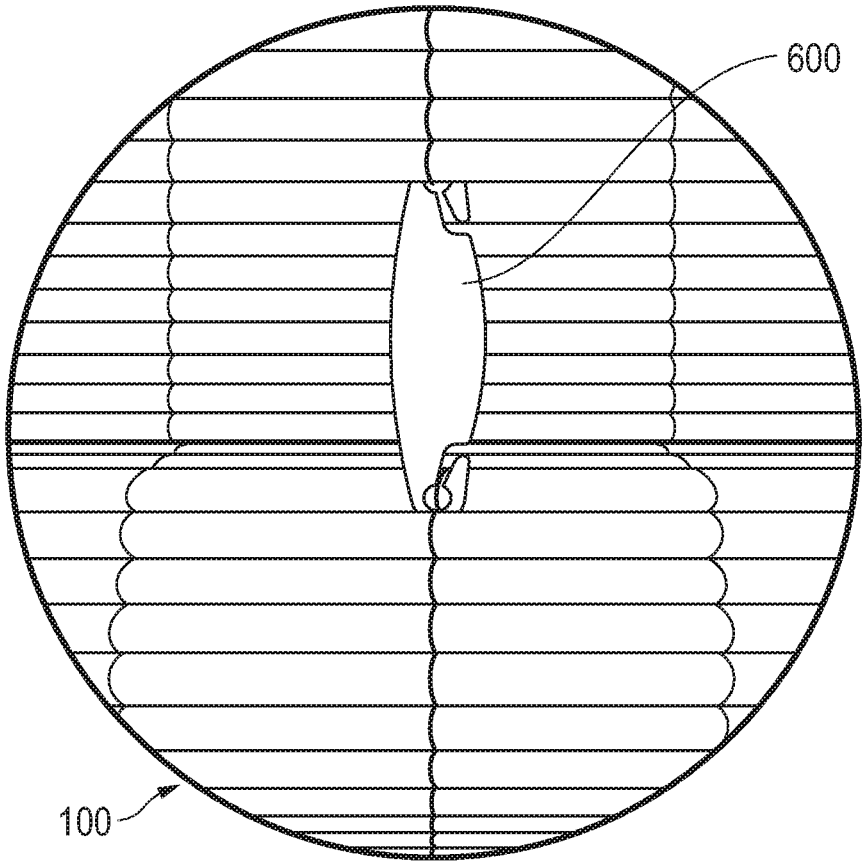
FIG. 20 is a diagram illustrating an example of the fastener of FIGS. 19A-19C attached to the shade for holding the shade in a rolled up position.

FIG. 20 is a diagram illustrating an example of the fastener 600 of FIGS. 19A-19C attached to the shade 100 for holding the shade 100 in a rolled up position. Similar to FIG. 18C showing fastener 500 holding up the rolled up portion of the shade 100, FIG. 20 is showing the fastener 600 holding up the rolled up portion of the shade 100. The method described for using the fastener 500 with shade 100 is also applicable for using fastener 600 with shade 100.

FIGS. 21A, 21B, 21C, 21D, 21E, and 21F are diagrams illustrating yet another example of a fastener 700 which may be removably attached to a shade 100 for holding the shade 100 in a rolled up position.

Figure 21A:
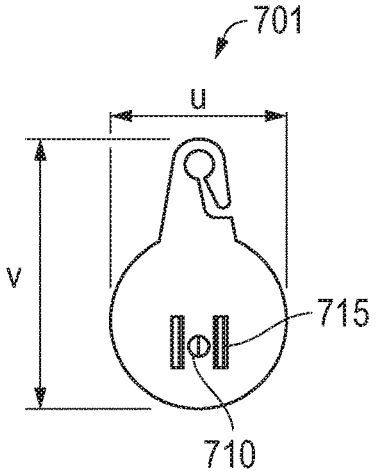
FIGS. 21A, 21B, 21C, 21D, 21E, and 21F are diagrams illustrating yet another example of a fastener which may be removably attached to a shade for holding the shade in a rolled up position.
Figure 21B:
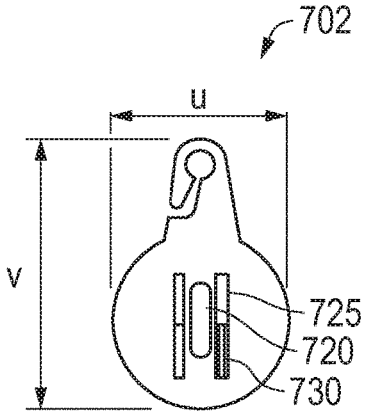
Figure 21C:
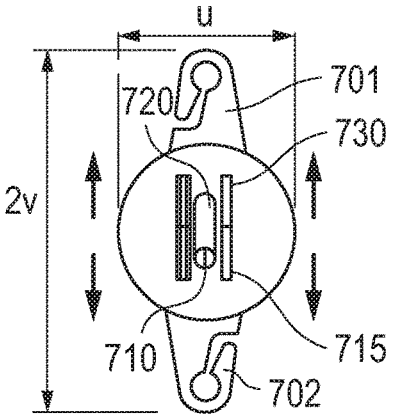

Referring to FIGS. 21A and 21B, the fastener 700 may be formed of two parts, a first part 701 and a second part 702. The first part 701 may include a pin 710 and a pair of track elements 715. The pin 710 and track elements 715 may correspond and fit into an opening 720 and tracks 725 of the second part 702, respectively. The tracks 725 of the second part 702 may also include elastic elements 730 such as springs which abut against the received track elements 715 of the first part 701. As a result, the track system including the track elements 715, the tracks 725, and the elastic elements 730 allow the fastener 700 to expand or retract. Referring to FIG. 21C, the fastener 700 is made up of the first part 701 and the second part 702 so that a hook or connecting element is extending from both ends. In this example, the length v of each part 701, 702 is about 1.94 inches, the width u of each part 701, 702 is about 1.26 inches, the length 2v of the fastener is about 2.63 inches, and the track system 715, 725, 730 allows the connector 700 to expand to about 3 inches.

Figure 21D:
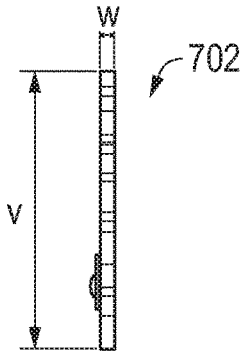
Figure 21E:
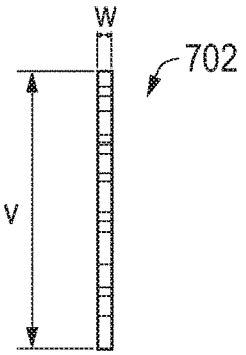
Figure 21F:
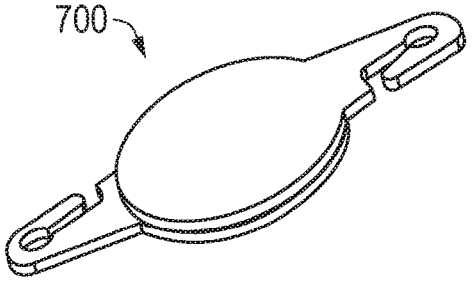

Referring to FIGS. 21D-21F, the thickness w of the fastener 700 including the thickness w of each part 701, 702 is about 0.07 inches. The purpose of the adjustable fastener 700 is to allow the fastener 700 to function with the shade/blind 100 to achieve varying lengths between the minimum and maximum extensions. The adjustable fastener 700 expands, and contracts based on the size of the slat area needed to secure the shade/blind 100 in the desired position. This is important because the shades/blinds 100 come in various material and slat heights and depths. The adjustable fastener 700 slides into position with the ability to adjust to about 2.63 inches and about 3 inches. The adjustable fastener 700 may attach to the thick weaving cord on the shade/blind 100 in a stationary location. This will secure the shade/blind 100 in a rolled position and at a desired height. It should be appreciated that any dimensions may be used and the dimensions described are only examples.

Figure 22:
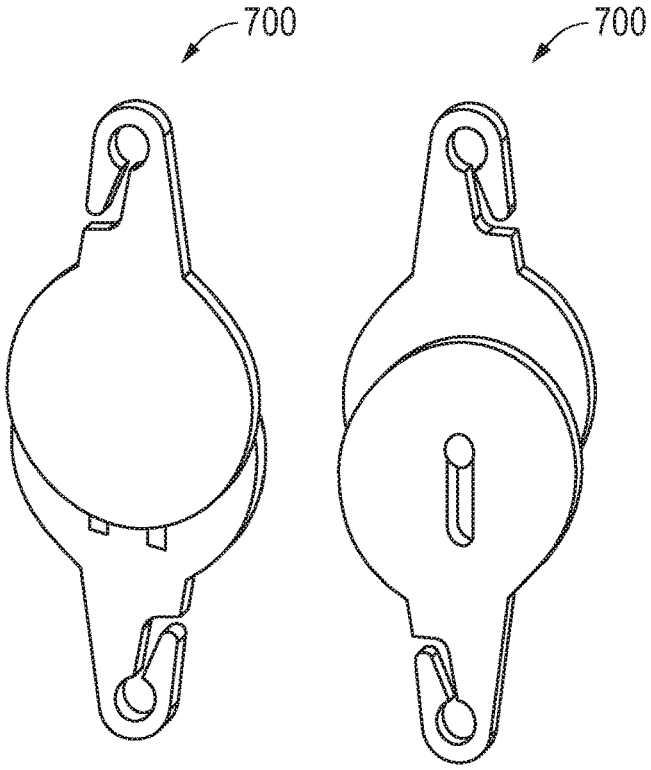
FIG. 22 is a diagram illustrating an example of the front and the back of the fastener of FIG. 24.
Figure 23:
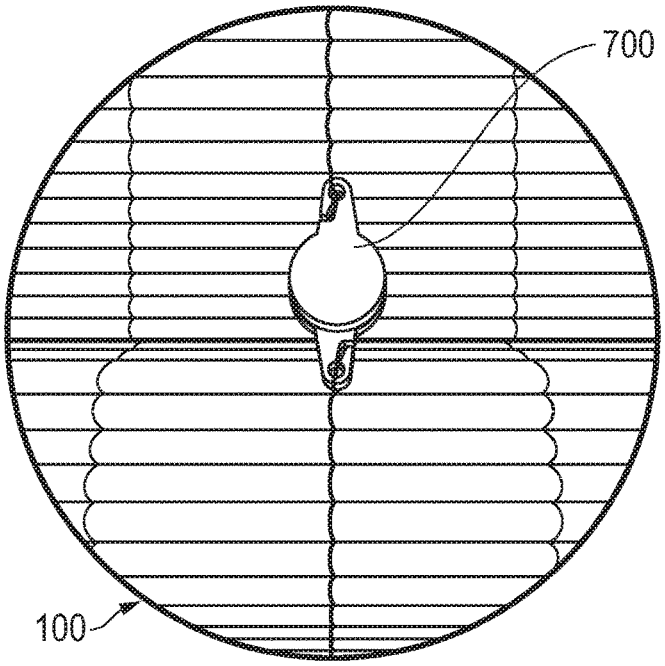
FIG. 23 is a diagram illustrating the fastener of FIGS. 21A-21F attached to the shade for holding the shade in a rolled up position.
Figure 24:
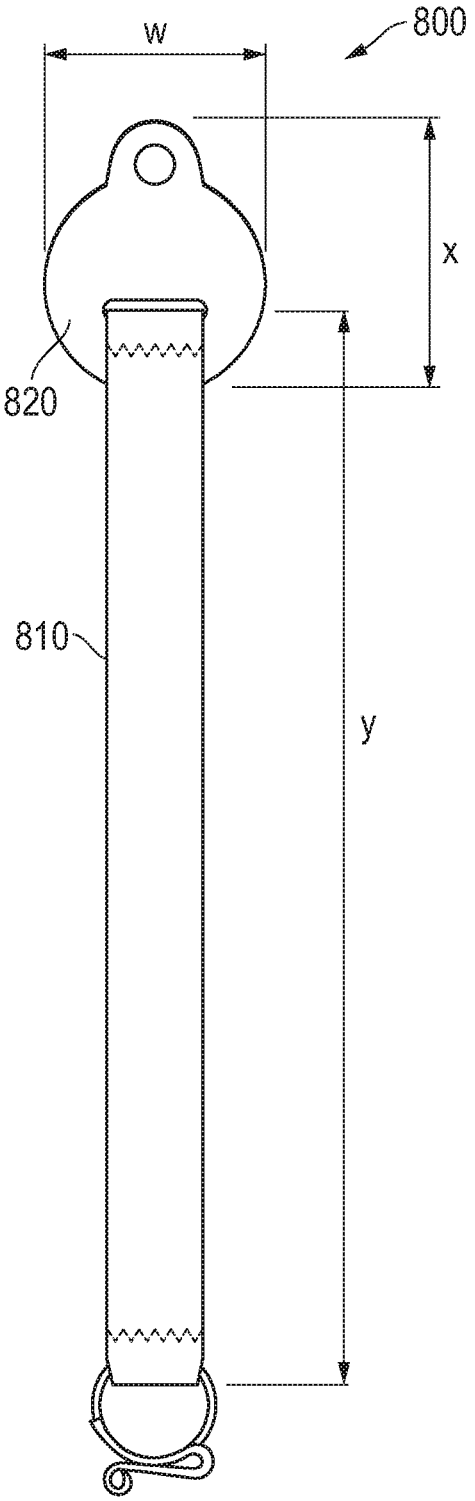
FIG. 24 is a diagram illustrating another example of a stow away storage strap for securing the shade in a storage position.

FIG. 22 is a diagram illustrating an example of the front and the back of the fastener 700 of FIG. 24. FIG. 23 is a diagram illustrating the fastener 700 of FIGS. 21A-21F attached to the shade 100 for holding the shade 100 in a rolled up position. Referring to FIG. 22, the fastener 700 is shown in a fully expanded configuration from a front and back side. Referring to FIG. 23, one end of the fastener 700 may be attached to a support cord on the front of the shade 100 while the other end of the fastener 700 may be attached to a support cord on a rear of the shade 100 and holding up a rolled up portion of the shade 100.

FIG. 24 is a diagram illustrating another example of a stow away storage strap 800 for securing the shade 100 in a storage position. At a higher position along the shade 100, a storage strap 800 may be removably or irremovably secured to the back of the shade 100, similar to the way that the strap 10 is secured and using a similar connector as the second connector 46. The storage strap 800 may have a first connector 820 which is similar to the first connector 20 of the strap 10, and which hooks or attaches in a similar way to a corresponding connector or hook on the front side of the top headrail. The storage strap 800 may secure the shade 100 all the way up and may include a heavy duty and thicker strap 800 and connector 820 than the strap 10. This provides optimal storage during off-season and is an optional strap that may be used with the shade 100. In this example, the storage strap 800 has a length y of about 6.63 inches. It should be appreciated that any dimensions may be used and the dimensions described are only examples.

Figure 25A:
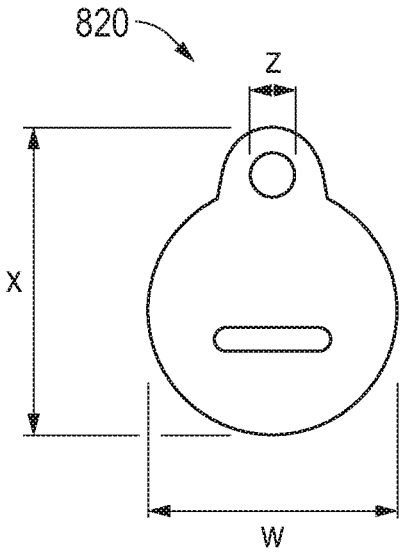
FIGS. 25A and 25B are diagrams illustrating an example of a connector for a storage strap.
Figure 25B:
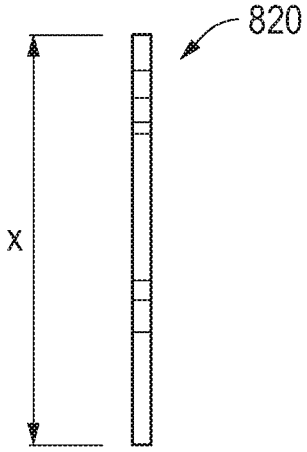

FIGS. 25A and 25B are diagrams illustrating an example of a connector 820 for a storage strap. Referring to FIGS. 25A and 25B, the connector 820 includes an upper arcuate portion and a lower arcuate portion, with the upper arcuate portion having a hole for receiving a hook. The lower arcuate portion includes a slit for receiving a loop of the storage strap. The hole may have a diameter z of 0.22 inches. The length x of the connector may be 1.57 inches and the width w may be 1.27 inches. It should be appreciated that any dimensions may be used and the dimensions described are only examples.

Figure 26:
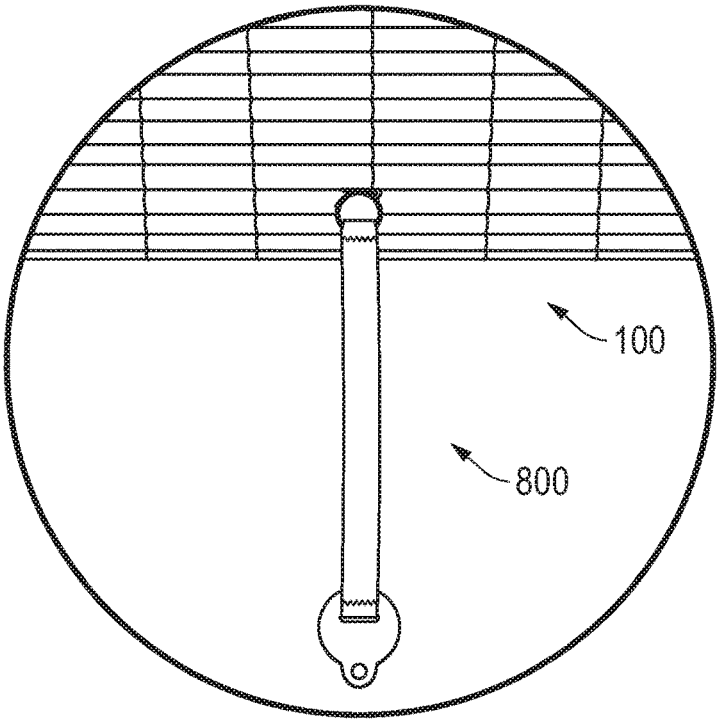
FIG. 26 is a diagram illustrating the storage strap of FIG. 24 attached to the support cord at the back of the shade.
Figure 27:
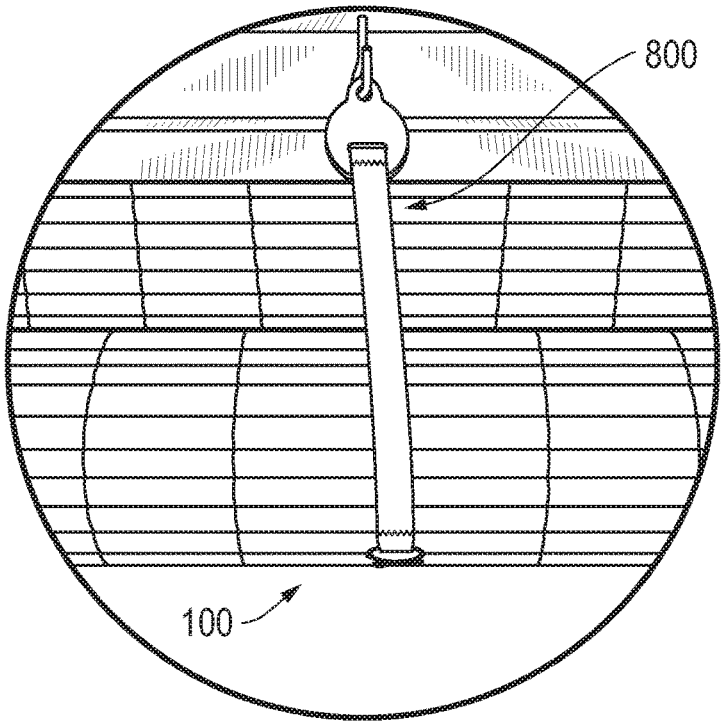
FIG. 27 is a diagram illustrating the storage strap of FIG. 24 attached to the support cord at the front of the shade.

FIG. 26 is a diagram illustrating the storage strap 800 of FIG. 24 attached to the support cord at the back of the shade 100. FIG. 27 is a diagram illustrating the storage strap 800 of FIG. 24 attached to the support cord at the front of the shade and holding up a rolled up portion of the shade 100. Similar to the illustrations shown in FIGS. 4-9, respectively, where the strap 10, 12, 14, 16 is used to secure a rolled up portion of the shade, the same approach may be used to secure the shade 100 using the strap 800, as illustrated in FIGS. 26 and 27. The hole of the connector 820 may hook onto a corresponding hook on the top headrail so that the shade 100 is stored all the way up, as illustrated.

Figure 28:
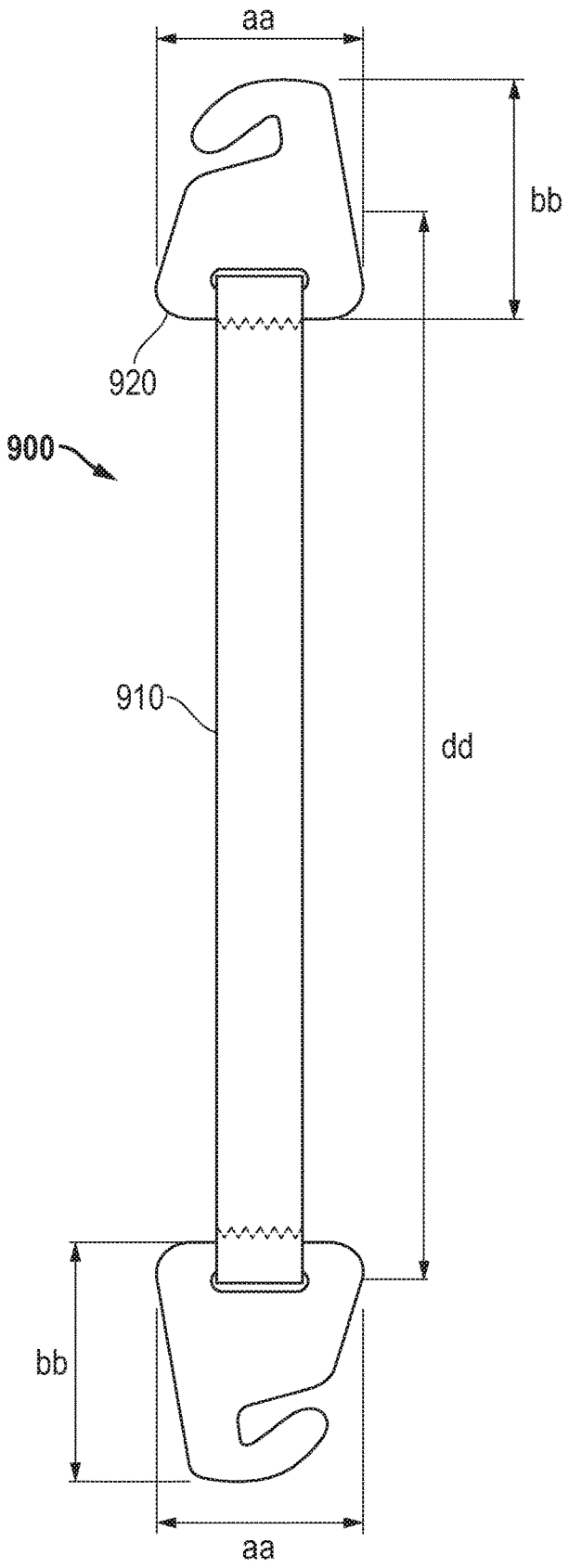
FIG. 28 is a diagram illustrating yet another example of a strap which may be removably attached to a shade for holding the shade in a rolled up position.

FIG. 28 is a diagram illustrating yet another example of a strap which may be removably attached to a shade for holding the shade in a rolled up position. Referring to FIG. 28, the strap 910 includes a pair of connector 920 which, in this example, are a removable hook which is detachable from the shade 100 and permanently attached to the strap 910. The connector 920 may also include other connection mechanisms which may be detachable or permanently attached from the strap 910 and/or from the shade 100 such as adhesives, hook and loop, clips, buttons, among other connection mechanisms. The strap 910 includes an elastic body which may be flexible to allow movement from a free hanging, straight position to a wrapped, curved position. The elastic body includes sew seams to ensure stability of the connectors 920.

Figure 29A:
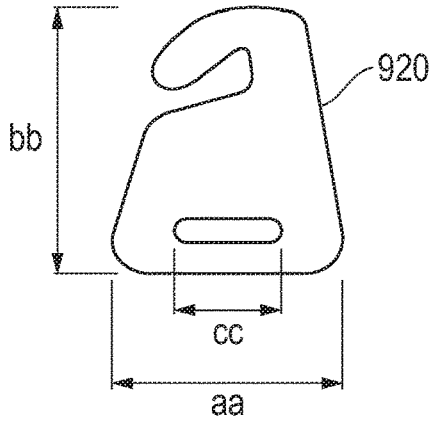
FIGS. 29A and 29B are diagrams illustrating an example of the removable connector used in the strap of FIG. 28.
Figure 29B:
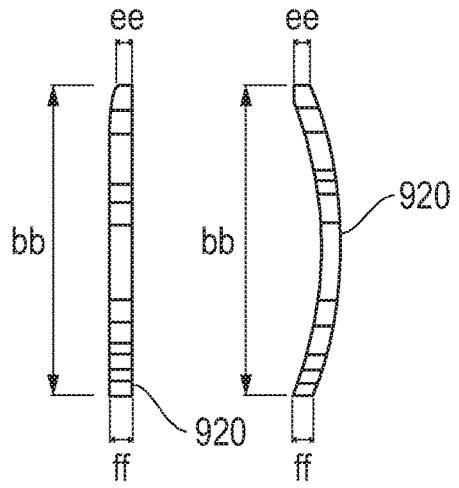

FIGS. 29A and 29B are diagrams illustrating an example of the connector 920 used in the strap 910 of FIG. 28. Referring to FIG. 28, a front view of the connector 920 is illustrated. The connector 920 may be made from a solid ABS plastic; however, any other material may also be used as is known by a person having ordinary skill in the art. Referring to FIG. 28, a side view of the connector 920 is illustrated. The connector 920 may be open with a hook-like projection on one end and a slot on the other end, with the hook end capable of securing blinds in place using a thicker cord and the slot capable of permanently receiving an elastic body of a strap as described throughout this application. The connector 920 is designed for easy assembly. In a preferred example, the connector 920 has an axial length bb of about 1.5 inches, a width aa of about 1.3 inches, and a thickness which tapers from a top thickness ee of about 0.04 inches to a bottom thickness ff of about 0.08 inches. The slot may have a width cc of about 0.6 inches and the strap may have a length of about 5 inches. It should be appreciated that any dimensions may be used and the dimensions described are only examples. Referring to FIG. 29B, the connector 920 may be straight (left side) or may have a concave shape (right side) as illustrated in the alternative examples of the side view.

One of skill in the art will recognize that the described examples are not limited to any particular size. Further one of skill in the art will recognize that the straps 10, 12, 14, 16, 110, 112, 114, 116, 200, connectors 20, 40, 42, 44, 46, 400, fasteners 500, 600, and shades 100 are not limited to any type of material. One skilled in the art will recognize that other diameters, types and thicknesses materials can be utilized when taking into consideration safety and stability consideration. A number of manufacturing techniques may be used.

It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. A fastener for attachment to a support cord of a shade for holding up a rolled up portion of the shade, the fastener comprising:

a first body portion comprising a top end, a bottom end, a right side, a left side, a first main body portion, a pin, and a pair of track elements;

a second body portion comprising a top end, a bottom end, a right side, a left side, a second main body portion having a same shape and size as the first main body portion, an opening, and a pair of tracks;

a first connector extending from the top end of the first main body portion of the first body portion; and a second connector extending from the bottom end of the second main body portion of the second body portion, wherein the first body portion and the second body portion are attached to one another by the pin being inserted through the opening, and the pair of track elements being inserted through the pair of tracks, in response to the fastener being in an at rest position, the first main body portion of the first body portion and the second main body portion of the second body portion completely overlap one another, in response to the fastener being in an expanded position, the first main body portion of the first body portion and the second main body portion of the second body portion are moved away from one another in an axial direction and only partially overlap, and the pair of track elements comprises a pair of projections projecting from the first main body portion in a lateral direction which is substantially perpendicular to the axial direction.

2. The fastener of claim 1, wherein the first connector is a first hook and the second connector is a second hook, and the first hook and the second hook are open from opposite sides of the fastener.

3. The fastener of claim 1, further comprising a pair of elastic elements which are positioned within the pair of tracks.

4. The fastener of claim 1, wherein a position of the first body portion with respect to the second body portion is adjustable.

* * * * *